US010474080B2

(12) United States Patent
Hirota et al.

(10) Patent No.: US 10,474,080 B2
(45) Date of Patent: Nov. 12, 2019

(54) IMAGE FORMING APPARATUS

(71) Applicant: CANON KABUSHIKI KAISHA, Tokyo (JP)

(72) Inventors: Junichi Hirota, Toride (JP); Toshifumi Itabashi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 15/703,215

(22) Filed: Sep. 13, 2017

(65) Prior Publication Data

US 2018/0095393 A1 Apr. 5, 2018

(30) Foreign Application Priority Data

Sep. 30, 2016 (JP) ..... 2016-192727
Jul. 13, 2017 (JP) ..... 2017-137182

(51) Int. Cl.
*G03G 15/00* (2006.01)

(52) U.S. Cl.
CPC ..... *G03G 15/5029* (2013.01); *G03G 15/55* (2013.01); *G03G 15/6529* (2013.01); *G03G 15/657* (2013.01); *G03G 2215/00751* (2013.01)

(58) Field of Classification Search
CPC ..... G03G 15/5029; G03G 15/55; G03G 15/6529; G03G 15/657; G03G 2215/00751
See application file for complete search history.

(56) References Cited

U.S. PATENT DOCUMENTS 5,962,861 A * 10/1999 Fowler ..... B65H 23/046 177/1
2007/0152396 A1* 7/2007 Tanahashi ..... B65H 3/06 271/109
2008/0272730 A1* 11/2008 Hoda ..... H02P 8/14 318/685
2015/0180392 A1* 6/2015 Taguchi ..... H02P 8/12 358/1.13
2017/0075265 A1* 3/2017 Chiba ..... G03G 15/2039
2018/0029388 A1* 2/2018 Matsui ..... B41J 13/0018

FOREIGN PATENT DOCUMENTS

JP 2009173380 A 8/2009
JP 2012181223 A 9/2012
JP 2013146173 A 7/2013

* cited by examiner

*Primary Examiner* — David H Banh
(74) *Attorney, Agent, or Firm* — Canon U.S.A., Inc. IP Division

(57) ABSTRACT

An image forming apparatus includes an image forming unit to form an image on a sheet, first and second rollers, a motor, a phase determiner, a controller, a current detector, and a discriminator. The motor drives the first roller which conveys the sheet. The second roller is downstream from the first roller. The phase determiner determines a rotation phase of a rotor of the motor. The controller controls a drive current flowing through a motor winding to reduce a deviation between a command phase representing a rotor target phase and the determined rotation phase. The current detector detects the drive current flowing through the winding. The discriminator determines a type of the sheet conveyed by the first roller based on a value of the drive current detected in a state in which the sheet is deflected while being conveyed by the first roller and not conveyed by the second roller.

37 Claims, 21 Drawing Sheets

FIG.8

| SHEET TYPE | iq [A] |
| --- | --- |
| PLAIN PAPER | 0.5 – 0.7 |
| THICK PAPER | 1.0 – 1.2 |

FIG.13

| SHEET TYPE | Δiq [A/s] |
| --- | --- |
| PLAIN PAPER | 2 – 4 |
| THICK PAPER | 10 – 12 |

FIG.18

| SHEET TYPE | Σiq [A] |
|---|---|
| PLAIN PAPER | 8 – 12 |
| THICK PAPER | 15 – 20 |

IMAGE FORMING APPARATUS

BACKGROUND OF THE INVENTION

Field of the Invention

The present disclosure relates to an image forming apparatus for forming an image on a recording medium.

Description of the Related Art

Conventionally, a method used in an image forming apparatus for forming an image on a recording medium is known which sets a magnitude of voltage to be supplied to a transfer charging device according to a type of the recording medium when a toner image formed on a surface of a photosensitive drum is transferred to a predetermined position of the recording medium. In addition, a method is known which sets a temperature of a fixing heater in a fixing device according to a type of a recording medium when toner transferred to a predetermined position of the recording medium is fixed thereto.

According to Japanese Patent Application Laid-Open No. 2012-181223, a configuration is described in which a sensor for determining a type of a recording medium (a sheet type) is installed in a conveyance path through which the recording medium is conveyed, and a magnitude of voltage to be supplied to a transfer charging device, a temperature of a fixing heater, and the like are set based on the determination result of the sensor.

However, the method for determining the sheet type according to the above-described Japanese Patent Application Laid-Open No. 2012-181223 requires a space for installing the sensor, and the image forming apparatus is enlarged. Further, installation of the sensor increases a cost.

SUMMARY OF THE INVENTION

The present disclosure is directed to determination of a type of a sheet without using a sensor for determining the type of the sheet.

According to an aspect of the present invention, an image forming apparatus includes an image forming unit configured to form an image on a sheet, a first roller configured to convey the sheet, a second roller configured to be adjacent to the first roller and installed on a downstream side from the first roller in a conveyance direction to which the sheet is conveyed, a motor configured to drive the first roller, a phase determiner configured to determine a rotation phase of a rotor of the motor, a controller configured to control a drive current flowing through a winding of the motor to reduce a deviation between a command phase representing a target phase of the rotor and the rotation phase determined by the phase determiner, a current detector configured to detect the drive current flowing through the winding, and a discriminator configured to determine a type of the sheet conveyed by the first roller based on a value of the drive current detected by the current detector in a state in which the sheet is deflected while being conveyed by the first roller and not conveyed by the second roller.

Further features of the present invention will become apparent from the following description of embodiments with reference to the attached drawings.

BRIEF DESCRIPTION OF THE DRAWINGS

FIG. 8 is a table indicating a correspondence relationship between a sheet type and a current value iq at time t2.

FIG. 13 is a table indicating a correspondence relationship between a sheet type and a change amount $\Delta iq$.

FIG. 18 is a table indicating a correspondence relationship between a sheet type and a sum $\Sigma iq$ of current values iq according to the third embodiment.

DESCRIPTION OF THE EMBODIMENTS

Various embodiments will now be described in detail below with reference to the attached drawings. However, shapes of components described in the embodiments and their relative positions are to be appropriately changed depending on a configuration and various conditions of an apparatus to which the present disclosure is applied and thus, the scope of the present disclosure is not limited only to the embodiments described below. A case in which a motor control apparatus is installed in an image forming apparatus is described below, however, it is not limited to the image forming apparatus in which the motor control apparatus is installed. For example, the motor control apparatus may be used in a sheet conveyance apparatus for conveying a sheet of a recording medium, a document, and the like.

[Image Forming Apparatus]

Figure 1:
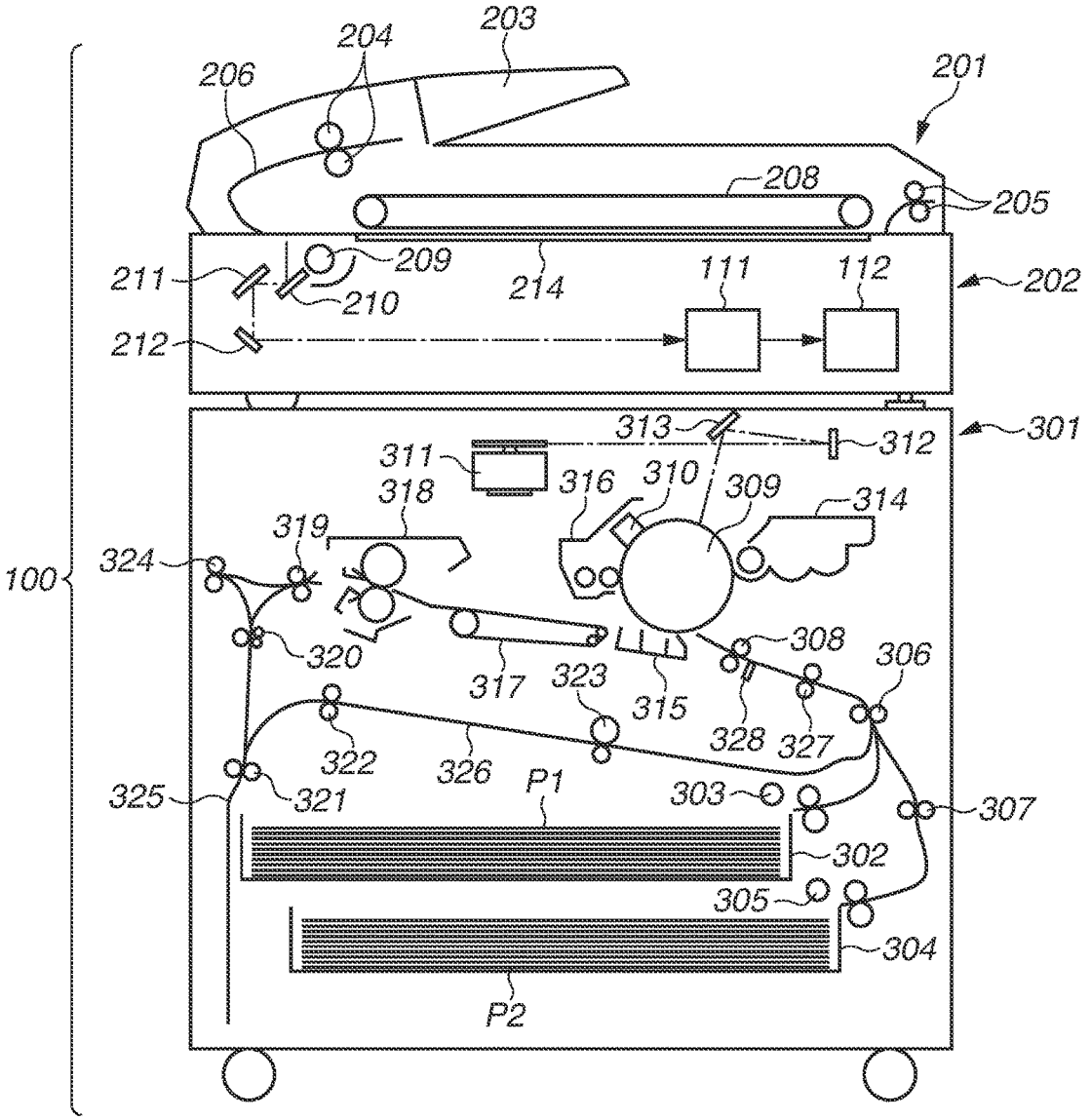
FIG. 1 is a cross-sectional view illustrating an image forming apparatus according to a first embodiment.

FIG. 1 is a cross-sectional view illustrating a configuration of an electrophotographic method monochromatic copy machine (hereinbelow, referred to as an image forming apparatus) 100 used as an image forming apparatus according to a first embodiment. The image forming apparatus is not limited to the copy machine and may be, for example, a facsimile apparatus, a printing apparatus, and a printer. Further, the recording method is not limited to the electrophotographic method, and, for example, an ink jet method can be used. Furthermore, the image forming apparatus may adopt any of a monochromatic format or a color format.

A configuration and a function of the image forming apparatus 100 are described below with reference to FIG. 1. As illustrated in FIG. 1, the image forming apparatus 100 includes a document feeding apparatus 201, a reading apparatus 202, and an image printing apparatus 301.

Documents placed on a document stacking unit 203 of the document feeding apparatus 201 are fed one by one by a sheet feeding roller 204 and conveyed onto a document glass platen 214 of the reading apparatus 202 along a conveyance guide 206. Further, the document is conveyed at a constant speed by a conveyance belt 208 and discharged to a discharge tray, which is not illustrated, by a sheet discharge roller 205. Reflected light from a document image which is illuminated by an illumination 209 at a reading position of the reading apparatus 202 is guided to an image reading unit 111 by an optical system constituted of reflection mirrors 210, 211, and 212 and converted into an image signal by the image reading unit 111. The image reading unit 111 is constituted of a lens, a charge coupled device (CCD) as a photoelectric conversion element, a driving circuit of the CCD, and the like. An image signal output from the image reading unit 111 is subjected to various correction processing by an image processing unit 112 constituted of a hardware device such as an application specific integrated circuit (ASIC) and output to the image printing apparatus 301. Reading of a document is performed as described above. In other words, the document feeding apparatus 201 and the reading apparatus 202 function as a document reading apparatus.

Document reading modes includes a first reading mode and a second reading mode. The first reading mode is a mode for reading an image on a document conveyed at a constant speed by the illumination system 209 and the optical system which are fixed to a predetermined position. The second reading mode is a mode for reading an image on a document placed on the document glass platen 214 of the reading apparatus 202 by the illumination system 209 and the optical system which move at a constant speed. Normally, a sheet-shaped document is read in the first reading mode, and a bound document such as a book and a booklet is read in the second reading mode.

The image printing apparatus 301 includes sheet storage trays 302 and 304 therein. The sheet storage trays 302 and 304 each can store different types of recording media. For example, the sheet storage tray 302 stores A4 size plain paper, and the sheet storage tray 304 stores A4 size thick paper. A recording medium is the one on which an image is formed by the image forming apparatus, and, for example, a sheet, a resin sheet, cloth, an overhead projector (OHP) sheet, a label, and the like are included in recording media.

The recording medium stored in the sheet storage tray 302 is fed by a sheet feeding roller 303 and conveyed by conveyance rollers 329 and 306 and a pre-registration roller 327 to a registration roller 308. The recording medium stored in the sheet storage tray 304 is fed by a sheet feeding roller 305 and conveyed by conveyance rollers 330, 307 and 306 and the pre-registration roller 327 to the registration roller 308. The pre-registration roller 327 according to the present embodiment corresponds to a first roller. Further, the registration roller 308 according to the present embodiment corresponds to an abutment member and a second roller.

An image signal output from the reading apparatus 202 is input to an optical scanning apparatus 311 including a semiconductor laser and a polygon mirror. A photosensitive drum 309 is charged by a charger 310 on an outer circumferential surface thereof. After the outer circumferential surface of the photosensitive drum 309 is charged, a laser beam corresponding to the image signal input from the reading apparatus 202 to the optical scanning apparatus 311 is emitted from the optical scanning apparatus 311 to the outer circumferential surface of the photosensitive drum 309 via the polygon mirror and mirror 312 and 313. Accordingly, an electrostatic latent image is formed on the outer circumferential surface of the photosensitive drum 309.

Subsequently, the electrostatic latent image is developed by a toner in a developing unit 314, and a toner image is formed on the outer circumferential surface of the photosensitive drum 309.

A transfer charging device 315 used for transferring the toner image to a recording medium is installed on a position (a transfer position) facing the photosensitive drum 309. The transfer charging device 315 is applied with a voltage suitable for a sheet type set by a user.

A sheet sensor 328 for detecting a leading edge of a recording medium is installed between the registration roller 308 and the pre-registration roller 327. The registration roller 308 and the pre-registration roller 327 correct skew feeding of a side on a leading edge side of the recording medium based on a detection result of the sheet sensor 328. A method of skew feeding correction is described in detail below. Subsequently, the registration roller 308 and the pre-registration roller 327 transmit the recording medium to the transfer position in accordance with a transfer timing at which the toner image is transferred by the transfer charging device 315 to the recording medium. The sheet sensor 328 according to the present embodiment is, for example, an optical sensor, but not limited to this type.

As described above, the recording medium on which the toner image is transferred is transmitted by a conveyance belt 317 to a fixing device 318 and heated and pressed by the fixing device 318, and thus the toner image is fixed onto the recording medium. The image forming apparatus 100 thus forms an image on a recording medium. A temperature of the fixing device 318 is controlled to be a temperature suitable for a sheet type.

When an image is formed in a one-sided printing mode, a recording medium passed through the fixing device 318 is discharged to the discharge tray, which is not illustrated, by sheet discharge rollers 319 and 324. When an image is formed in a two-sided printing mode, the fixing device 318 performs fixing processing on a first surface of a recording medium, and then the recording medium is conveyed to a reversing path 325 by the sheet discharge roller 319, a conveyance roller 320, and a reversing roller 321. The recording medium is conveyed to the registration roller 308 again by conveyance rollers 322 and 323, and an image is formed on a second surface of the recording medium by the above-described method. Subsequently, the recording medium is discharged to the discharge tray, which is not illustrated, by the sheet discharge rollers 319 and 324.

When the recording medium which is subjected to the image forming on the first surface is discharged with its face down to the outside of the image forming apparatus 100, the recording medium passed through the fixing device 318 is conveyed to a direction toward the conveyance roller 320 via the sheet discharge roller 319. Subsequently, rotation of the conveyance roller 320 is reversed immediately before a rear end of the recording medium passes through a nip portion of the conveyance roller 320, and thus the recording medium is discharged with the first surface thereof face down to the outside of the image forming apparatus 100 via the sheet discharge roller 324.

Thus, the configuration and the function of the image forming apparatus 100 are described above. The motor control apparatus according to the present embodiment can be applied to a motor which drives a load. A load corresponds to, for example, various rollers such as the sheet feeding rollers 204, 303, and 305, the pre-registration roller 327, the registration roller 308, and the sheet discharge roller 319, the photosensitive drum 309, the conveyance belts 208 and 317, the illumination system 209, and the optical system.

Figure 2:
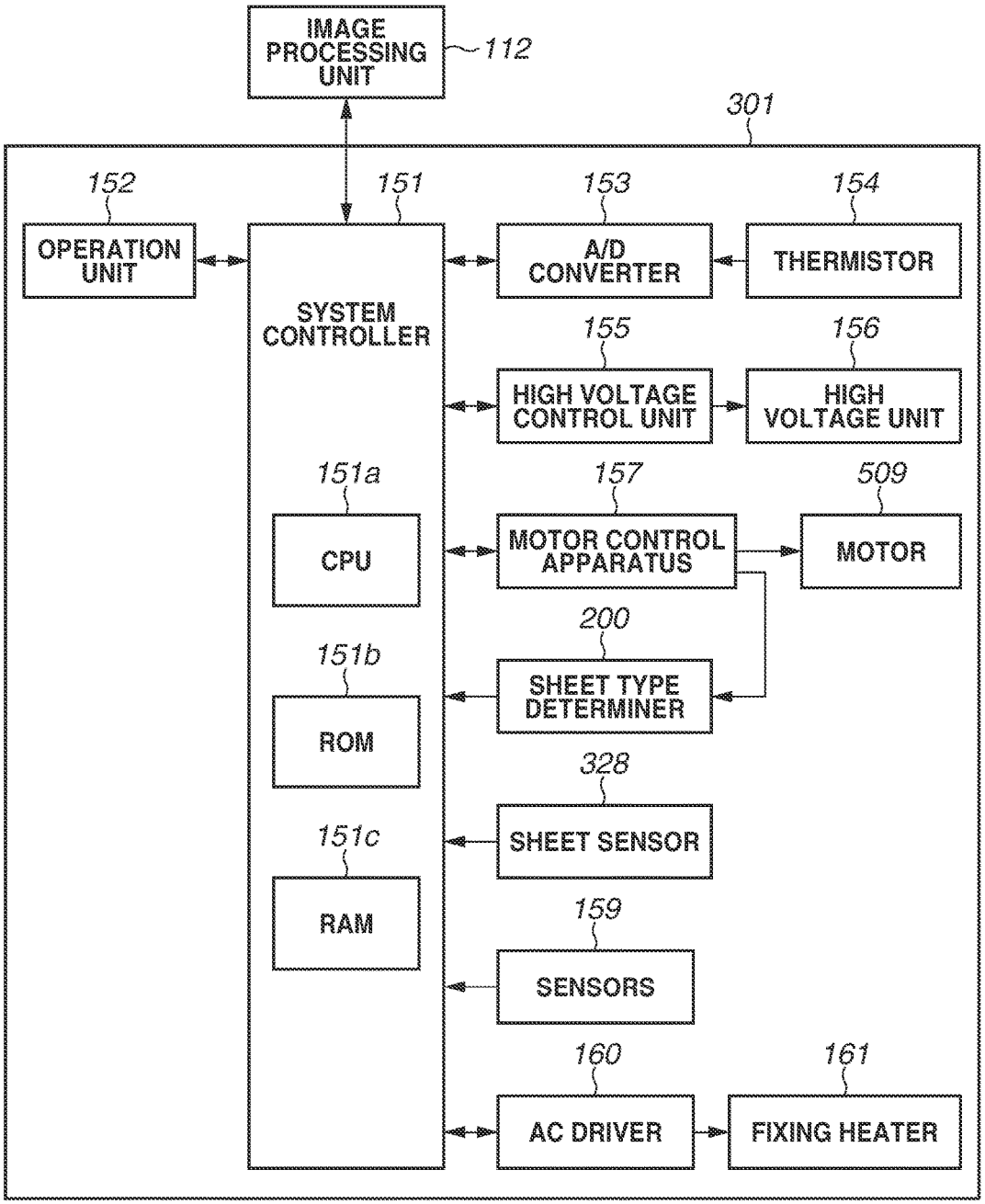
FIG. 2 is a block diagram illustrating a control configuration of the image forming apparatus.

FIG. 2 is a block diagram illustrating an example of a control configuration of the image forming apparatus 100. A system controller 151 includes a CPU 151*a*, a read-only memory (ROM) 151*b*, and a random access memory (RAM) 151*c* as illustrated in FIG. 2. The system controller 151 is connected to the image processing unit 112, an operation unit 152, an analog-to-digital (A/D) converter 153, a high voltage control unit 155, a motor control apparatus 157, a sheet type determiner 200, sensors 159, and the like. The system controller 151 can transmit and receive data and a command to and from each connected unit.

The CPU 151*a* reads and executes various programs stored in the ROM 151*b* and thus executes various sequences related to predetermined image formation sequences.

The RAM 151*c* is a storage device. The RAM 151*c* stores various data pieces, such as a setting value to the high voltage control unit 155, a command value to the motor control apparatus 157, and information pieces received from the operation unit 152.

The system controller 151 receives a signal from the operation unit 152, the sensors 159, the sheet type determiner 200, or the like, sets a setting value of the high voltage control unit 155, a command value to the motor control apparatus 157, and the like and stores the values in the RAM 151*c*. Further, the system controller 151 transmits, to the image processing unit 112, setting value data pieces of various apparatuses installed within the image forming apparatus 100 necessary for image processing by the image processing unit 112. A sheet type determination method by the sheet type determiner 200 is described below.

The high voltage control unit 155 reads the setting value set by the system controller 151 from the RAM 151*c* and supplies a necessary voltage to high voltage units 156 (the charger 310, the developing unit 314, the transfer charger 315, and the like).

The system controller 151 (the CPU 151*a*) outputs a command to the motor control apparatus 157 based on the detection result of the sheet sensor 328. The motor control apparatus 157 controls a motor 509 for driving the pre-registration roller 327 in response to the command received from the CPU 151*a*. In FIG. 2, the motor 509 is only illustrated as a motor in the image forming apparatus, however, the image forming apparatus is actually provided with a plurality of motors. One motor control apparatus may control a plurality of motors. Further, in FIG. 2, only one motor control apparatus is provided, however, two or more motor control apparatuses may be installed in the image forming apparatus.

The A/D converter 153 receives a detection signal detected by a thermistor 154 for detecting a temperature of a fixing heater 161, converts the detection signal from an analog signal to a digital signal, and transmits the digital signal to the system controller 151. The system controller 151 controls the AC driver 160 based on the digital signal received from the A/D converter 153. The AC driver 160 controls the fixing heater 161 so that a temperature of the fixing heater 161 to be a temperature necessary for performing fixing processing on a used sheet. The fixing heater 161 is a heater used for fixing processing and is included in the fixing unit 318.

The system controller 151 controls the operation unit 152 to display an operation screen enabling a user to set a type and the like of a sheet to be used on a display unit provided in the operation unit 152. The system controller 151 receives information set by a user from the operation unit 152 and controls an operation sequence of the image forming apparatus 100 based on the information set by the user. Further, the system controller 151 transmits information indicating a state of the image forming apparatus to the operation unit 152. The information indicating the state of the image forming apparatus includes, for example, the number of image forming sheets, a progress status of an image forming operation, information regarding a jam and overlapping conveyance of sheets in the document feeding apparatus 201 and the image printing apparatus 301, and the like. The operation unit 152 displays the information received from the system controller 151 on the display unit.

The system controller 151 thus controls the operation sequence of the image forming apparatus 100 as described above.

[Motor Control Apparatus]

Next, the motor control apparatus according to the present embodiment is described. The motor control apparatus according to the present embodiment controls the motor using vector control.

<Vector Control>

First, a method for performing vector control by the motor control apparatus 157 according to the present embodiment is described with reference to FIGS. 3 and 4. The motor described below is not provided with a sensor such as a rotary encoder for detecting a rotation phase of a rotor of the motor, however, the motor may be provided with the sensor such as the rotary encoder.

Figure 3:
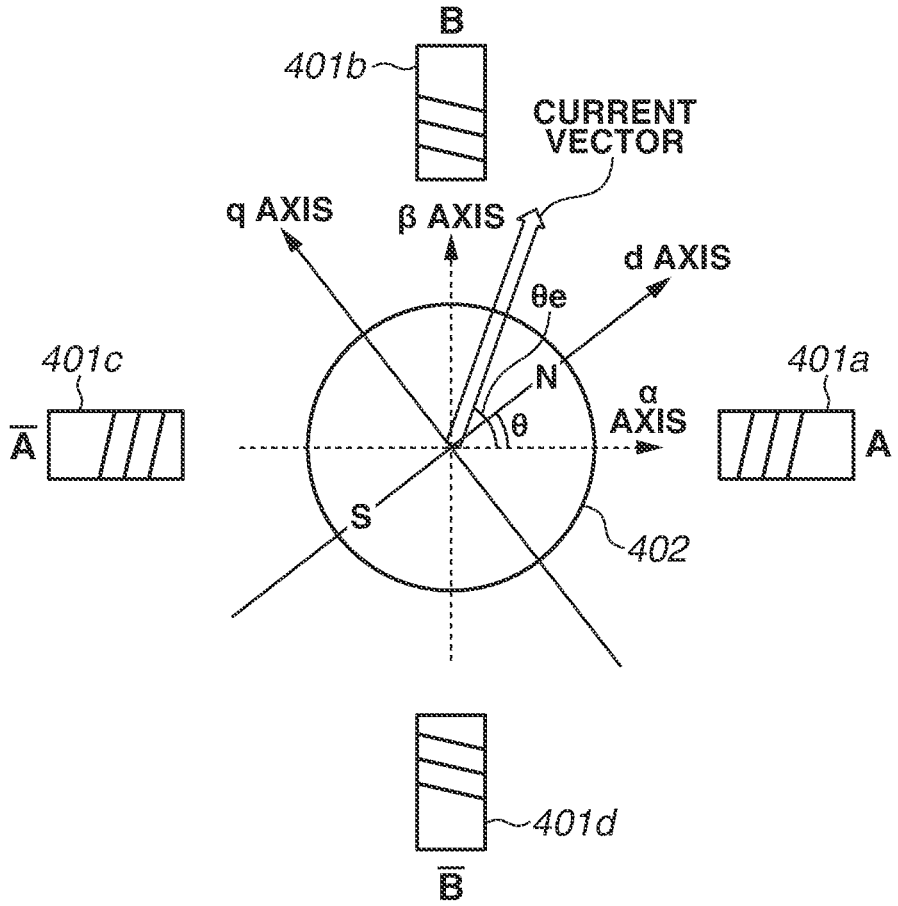
FIG. 3 illustrates a relationship between a two phase motor including an A phase and a B phase and a d axis and a q axis in a rotating coordinate system.

FIG. 3 illustrates a relationship between a stepping motor (hereinbelow, referred to as a motor) 509 consisting of two phases of an A phase (a first phase) and a B phase (a second phase) and a rotating coordinate system expressed by a d axis and a q axis. In FIG. 3, an $\alpha$ axis corresponding to a winding of the A phase and a $\beta$ axis corresponding to a winding of the B phase are defined in a stationary coordinate system. Further, in FIG. 3, the d axis is defined along a direction of a magnetic flux generated by a magnetic pole of a permanent magnet used in a rotor 402, and the q axis is defined along a direction advanced 90 degrees counterclockwise from the d axis (a direction perpendicular to the d axis). An angle formed by the $\alpha$ axis and the d axis is defined as $\theta$, and a rotation phase of the rotor 402 is expressed by a degree $\theta$. In the vector control, the rotating coordinate system based on the rotation phase $\theta$ of the rotor 402 is used. Specifically, in the vector control, a q axis component (a torque current component) generating torque in a rotor and a d axis component (an excitation current component) affecting intensity of a magnetic flux penetrating through the winding are used which are current components in the rotating coordinate system of a current vector corresponding to a drive current flowing through the winding.

The vector control is a control method for controlling a motor by performing phase feedback control which controls a torque current component value and an excitation current component value so as to reduce a deviation between a command phase representing a target phase and an actual rotation phase of a rotor. In addition, there is a control method for controlling a motor by performing speed feedback control which controls a torque current component value and an excitation current component value so as to reduce a deviation between a command speed representing a target speed and an actual rotation speed of a rotor.

Figure 4:
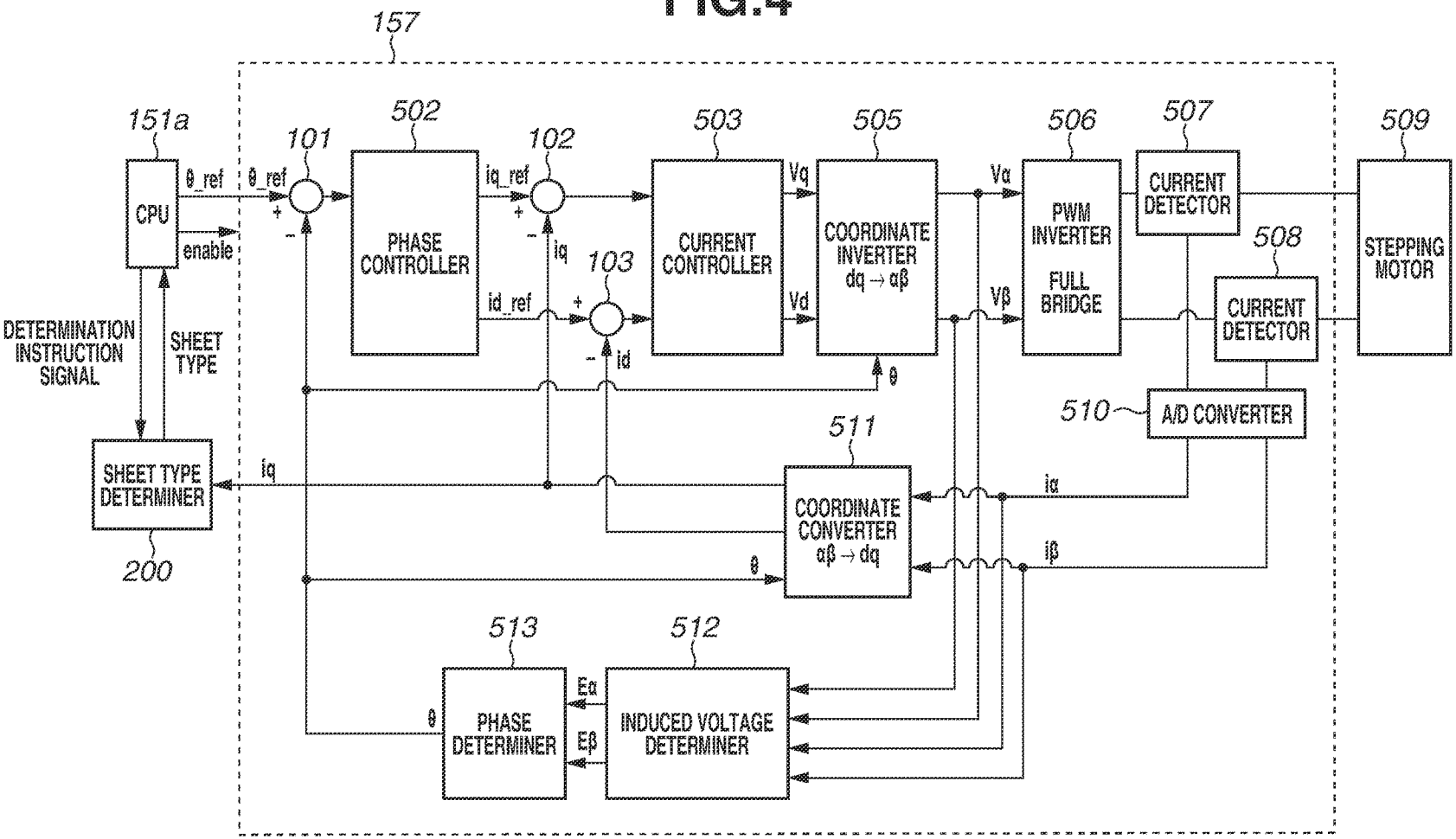
FIG. 4 is a block diagram illustrating a configuration of a motor control apparatus according to the first embodiment.

FIG. 4 is a block diagram illustrating an example of a configuration of the motor control apparatus 157 for controlling the motor 509. The motor control apparatus 157 is constituted of at least one ASIC and executes each function described below.

As illustrated in FIG. 4, the motor control apparatus 157 includes a phase controller 502, a current controller 503, a coordinate inverter 505, a coordinate converter 511, a pulse-width modulation (PWM) inverter 506 for supplying a drive current to the motor winding, and the like as circuits for performing the vector control. The coordinate converter 511 converts coordinates of the current vectors corresponding to drive currents flowing through the windings of the A phase and the B phase of the motor 509 from the stationary coordinate system expressed by the α axis and the β axis to the rotating coordinate system expressed by the q axis and the d axis. Accordingly, the drive current flowing through the winding is expressed by a current value of the q axis component (a q axis current) and a current value of the d axis component (a d axis current) which are current values in the rotating coordinate system. The q axis current corresponds to a torque current for generating torque in the rotor 402 of the motor 509. The d axis current corresponds to an excitation current affecting intensity of a magnetic flux penetrating through the winding of the motor 509 which does not contribute to torque generation in the rotor 402. The motor control apparatus 157 can independently control each of the q axis current and the d axis current. Accordingly, the motor control apparatus 157 controls the q axis current in response to load torque on the rotor 402 and thus can efficiently generate torque necessary for the rotor 402 to rotate. In other words, in the vector control, a magnitude of the current vector illustrated in FIG. 3 changes in response to the load torque on the rotor 402.

The motor control apparatus 157 determines the rotation phase θ of the rotor 402 of the motor 509 by a method described below and performs the vector control based on the determined result. The CPU 151*a* generates a command phase θ_ref representing a target phase of the rotor 402 of the motor 509 and outputs the command phase θ_ref to the motor control apparatus 157.

A subtractor 101 calculates a deviation between the rotation phase θ and the command phase θ_ref of the rotor 402 of the motor 509 and outputs the deviation to the phase controller 502 at a predetermined time period T (for example, 200 μs).

The phase controller 502 generates and outputs a q axis current command value iq_ref and a d axis current command value id_ref based on proportional control (P), integration control (I), and differential control (D) so as to reduce the deviation output from the subtractor 101. Specifically, the phase controller 502 generates and outputs the q axis current command value iq_ref and the d axis current command value id_ref based on the P control, the I control, and the D control so that the deviation output from the subtractor 101 becomes zero. The P control is a control method for controlling a control target value based on a value proportional to a deviation of a command value and an estimation value. The I control is a control method for controlling a control target value based on a value proportional to time integration of a deviation of a command value and an estimation value. The D control is a control method for controlling a control target value based on a value proportional to a temporal change of a deviation of a command value and an estimation value. The phase controller 502 according to the present embodiment generates the q axis current command value iq_ref and the d axis current command value id_ref based on the PID control, however, the control method is not limited to the PID control. For example, the phase controller 502 may generate the q axis current command value iq_ref and the d axis current command value id_ref based on the PI control. When a permanent magnet is used in the rotor 402, the d axis current command value id_ref affecting the intensity of the magnetic flux penetrating through the winding is normally set to zero, however, the value is not limited to this setting.

The drive currents flowing through the windings of the A phase and the B phase of the motor 509 are detected by current detectors 507 and 508 and then converted from analog values to digital values by an A/D converter 510. According to the present embodiment, a period at which the A/D converter 510 outputs a digital value is, for example, shorter than a period T (for example, 25 μs) at which the subtractor 101 outputs the deviation to the phase controller 502, however, the period is not limited to this.

Current values of the drive currents converted from the analog values to the digital values by the A/D converter 510 are expressed as current values iα and iβ in the stationary coordinate system by following formulae using a phase θe of the current vector illustrated in FIG. 3. The phase θe of the current vector is defined as an angle formed by the α axis and the current vector. I represents a magnitude of the current vector.

$$i\alpha = I^* \cos \theta e \tag{1}$$

$$i\beta = I^* \sin \theta e \tag{2}$$

The current values iα and iβ are input to the coordinate converter 511 and an induced voltage determiner 512.

The coordinate converter 511 converts the current values iα and iβ in the stationary coordinate system to a current value iq of the q axis current and a current value id of the d axis current in the rotating coordinate system by following formulae.

$$id = \cos \theta^* i\alpha + \sin \theta^* i\beta \tag{3}$$

$$iq = -\sin \theta^* i\alpha + \cos \theta^* i\beta \tag{4}$$

The coordinate converter 511 outputs the converted current value iq to a subtractor 102. In addition, the coordinate converter 511 outputs the converted current value id to a subtractor 103.

The subtractor 102 calculates a deviation between the q axis current command value iq_ref and the current value iq and outputs the deviation to the current controller 503.

The subtractor 103 calculates a deviation between the d axis current command value id_ref and the current value id and outputs the deviation to the current controller 503.

The current controller 503 generates drive voltages Vq and Vd based on the PID control so as to reduce the deviations respectively input thereto. Specifically, the current controller 503 generates the drive voltages Vq and Vd so that the input deviations respectively become zero and outputs the voltages to the coordinate inverter 505. In other words, the current controller 503 functions as a generation unit. The current controller 503 according to the present embodiment generates the drive voltages Vq and Vd based on the PID control, however, the control method is not limited to the PID control. For example, the current controller 503 may generate the drive voltages Vq and Vd based on the PI control.

The coordinate inverter 505 inversely converts the drive voltages Vq and Vd in the rotating coordinate system output from the current controller 503 into drive voltages Vα and Vβ in the stationary coordinate system by following formulae.

$$V\alpha=\cos\theta*Vd-\sin\theta*Vq \quad (5)$$

$$V\beta=\sin\theta*Vd+\cos\theta*Vq \quad (6)$$

The coordinate inverter 505 outputs the inversely converted drive voltages Vα and Vβ to the induced voltage determiner 512 and the PWM inverter 506.

The PWM inverter 506 includes a full bridge circuit. The full bridge circuit is driven by a PWM signal based on the drive voltages Vα and Vβ input from the coordinate inverter 505. Accordingly, the PWM inverter 506 generates drive currents iα and iβ corresponding to the drive voltages Vα and Vβ supplies the drive currents iα and iβ to the windings of the respective phases of the motor 509, and thus drives the motor 509. In other words, the PWM inverter 506 functions as a supply unit for supplying a current to the winding of each phase of the motor 509. According to the present embodiment, the PWM inverter includes the full bridge circuit, however, the PWM inverter may include, for example, a half bridge circuit.

Next, a method for determining the rotation phase θ is described. For determination of the rotation phase θ of the rotor 402, values of induced voltages Eα and Eβ are used which are induced in the windings of the A phase and the B phase of the motor 509 by rotation of the rotor 402. Values of induced voltages are determined (calculated) by the induced voltage determiner 512. Specifically, the induced voltages Eα and Eβ are determined by following formulae based on the current values iα and iβ input from the A/D converter 510 to the induced voltage determiner 512 and the drive voltages Vα and Vβ input from the coordinate inverter 505 to the induced voltage determiner 512.

$$E\alpha=V\alpha-R*i\alpha-L*di\alpha/dt \quad (7)$$

$$E\beta=V\beta-R*i\beta-L*di\beta/dt \quad (8)$$

Here, R represents a winding resistance, and L represents a winding inductance. Values of the winding resistance R and the winding inductance L are specific to the motor 509 to be used and stored in advance in the ROM 151*b* or a memory (not illustrated) installed in the motor control apparatus 157.

The induced voltages Eα and Eβ determined by the induced voltage determiner 512 are input to a phase determiner 513.

The phase determiner 513 determines the rotation phase θ of the rotor 402 of the motor 509 by a following formula based on a ratio of the induced voltage Eα and the induced voltage Eβ output from the induced voltage determiner 512.

$$\theta=\tan^{-1}(-E\beta/E\alpha) \quad (9)$$

According to the present embodiment, the phase determiner 513 determines the rotation phase θ by calculation based on the formula (9), however, the determination method is not limited to the above-described one. For example, the phase determiner 513 may determine the rotation phase θ by referring to a table indicating relationships between the induced voltage Eα and the induced voltage Eβ and the rotation phase θ corresponding to the induced voltage Eα and the induced voltage Eβ stored in the ROM 151*b* and the like.

The rotation phase θ of the rotor 402 obtained as described above is input to the subtractor 101, the coordinate inverter 505, and the coordinate converter 511.

The motor control apparatus 157 repeats the above-described control.

As described above, the motor control apparatus 157 according to the present embodiment performs the vector control for controlling the current value in the rotating coordinate system so as to reduce the deviation between the command phase θ_ref and the rotation phase θ. Performing the vector control can suppress a step-out state of the motor and increase of motor sound and power consumption due to surplus torque.

[Method for Determining Sheet Type]

Next, a configuration for determining a sheet type according to the present embodiment is described. According to the present embodiment, a below described configuration is applied to the image forming apparatus, and thus a type of a sheet can be determined without using a sensor for determining the type of the sheet.

Figure 5:
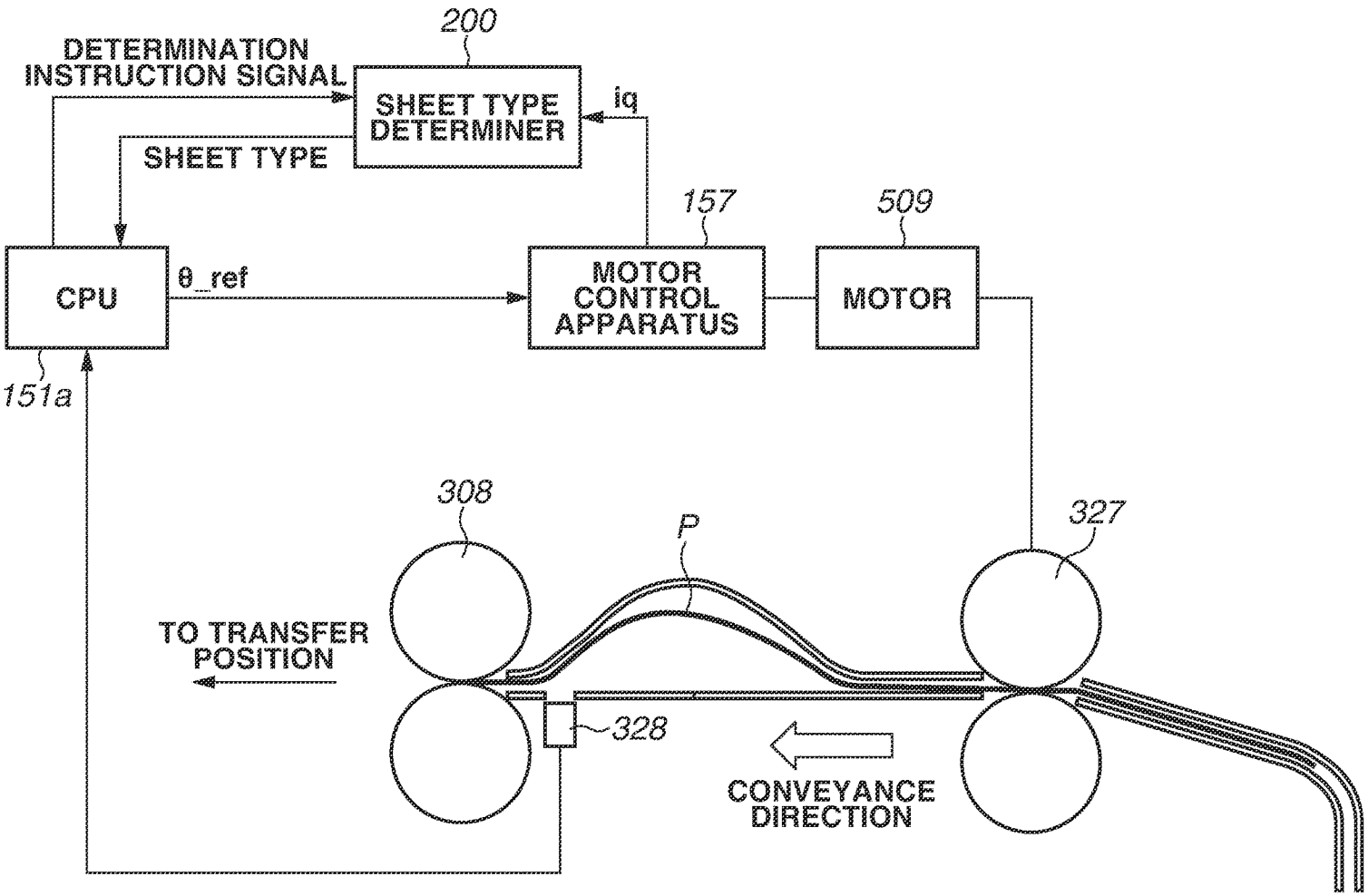
FIG. 5 illustrates a configuration for correcting skew feeding of a side on a leading edge side of a recording medium.

FIG. 5 illustrates a configuration for correcting skew feeding of a side on a leading edge side of a recording medium.

Skew feeding correction of a recording medium P is performed by the registration roller 308 and the pre-registration roller 327. Specifically, the motor control apparatus 157 controls driving of the motor 509, and thus the motor 509 rotates, and since the motor 509 rotates, the pre-registration roller 327 rotates. When the pre-registration roller 327 rotates, the recording medium P is conveyed to a conveyance direction, and a leading edge of the recording medium P abuts on a nip portion of the registration roller 308 in a stopped state. Subsequently, the motor control apparatus 157 further rotates the motor 509 and thus rotates the pre-registration roller 327. Accordingly, the recording medium P is further conveyed to the conveyance direction and deflected.

In the above-described process, the CPU 151*a* controls the motor control apparatus 157 to rotate the pre-registration roller 327 for a predetermined time T1 from when the sheet sensor 328 detects the leading edge of the recording medium P. In other words, the CPU 151*a* controls the motor control apparatus 157 to stop rotation of the pre-registration roller 327 after a lapse of the predetermined time T1 from when the sheet sensor 328 detects the leading edge of the recording medium P. The predetermined time T1 is set to a time length in which a deflection amount of the recording medium P after the predetermined time T1 from when the sheet sensor 328 detects the leading edge of the recording medium can be a deflection amount necessary for appropriately performing skew feeding correction on the recording medium P.

A method for stopping rotation of the pre-registration roller 327 is, for example, as follows. Specifically, the CPU 151*a* outputs a command phase same as the command phase previously outputs as the command phase θ_ref to the motor control apparatus 157. Subsequently, the CPU 151*a* continues to output the same command phase to the motor control apparatus 157. Accordingly, the motor control apparatus 157 can fix the phase of the rotor 402. In other words, the CPU 151*a* can stop the rotation of the pre-registration roller 327. In addition, a configuration may be adopted in which the CPU 151*a* outputs an enable signal 'L' to the motor control apparatus 157, the motor control apparatus 157 stops the motor 509 for driving the pre-registration roller 327, and thus the rotation of the pre-registration roller 327 is stopped. An enable signal is a signal for permitting or prohibiting an operation of the motor control apparatus 157. When the enable signal is 'L (low level)', the CPU 151*a* prohibits the operation of the motor control apparatus 157. In other words, the control of the motor 509 by the motor control apparatus 157 is terminated. Further, when the enable signal is 'H (high level)', the CPU 151*a* permits the operation of the motor control apparatus 157, and the motor control apparatus 157 controls driving of the motor 509 based on the command output from the CPU 151*a*.

As described above, the pre-registration roller 327 rotates for the predetermined time T1 from when the sheet sensor 328 detects the leading edge of the recording medium P, and thus the recording medium P is deflected. Accordingly, an elastic force is exerted on the recording medium P, and the leading edge of the recording medium P abuts on the registration roller along the nip portion thereof. Accordingly, skew feeding of the recording medium P is corrected.

Figure 6:
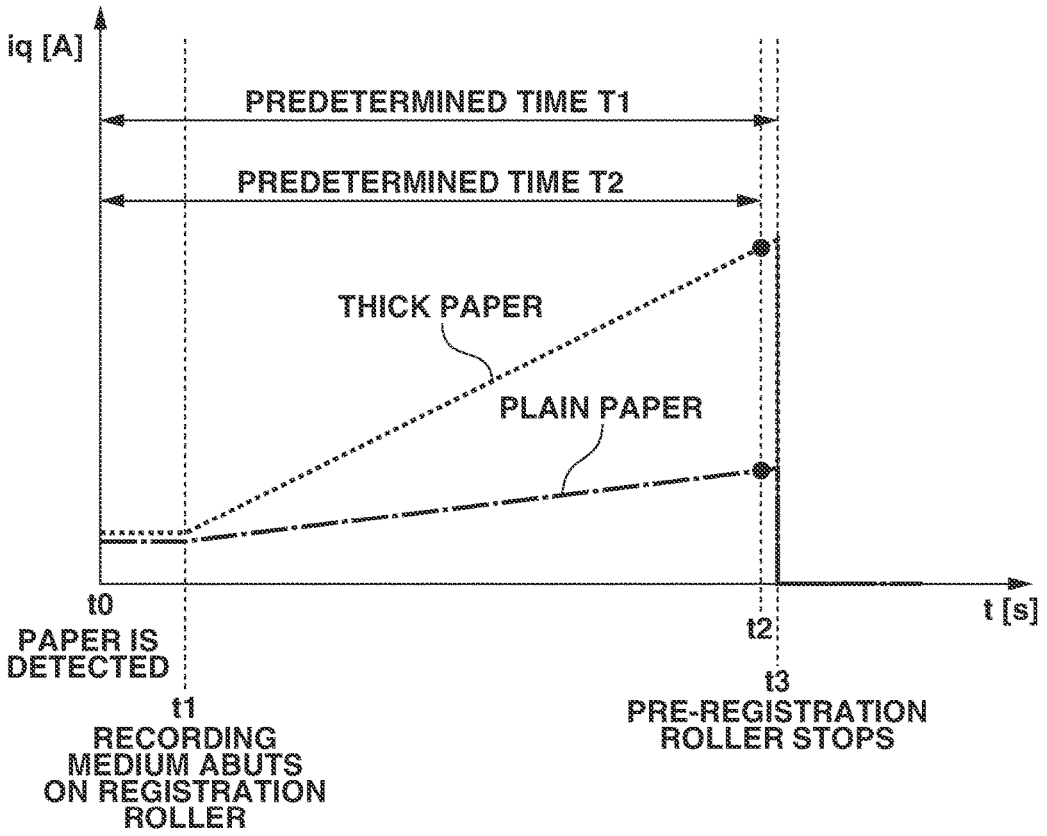
FIG. 6 illustrates a change of a current value iq in a process for correcting skew feeding according to the first embodiment.

FIG. 6 illustrates a change of the current value iq in the process for correcting skew feeding FIG. 6 illustrates the current value iq when skew feeding correction is performed on thick paper and the current value iq when skew feeding correction is performed on plain paper as an example according to the present embodiment.

As illustrated in FIG. 6, when the predetermined time T1 elapses from time t0 at which the sheet sensor 328 detects the leading edge of the recording medium P, the motor control apparatus 157 stops the rotation of the motor 509. The predetermined time T1 corresponds to a time length from the time t0 to time t3.

During a period when the recording medium is deflected, an elastic force is exerted on the recording medium. In other words, on the recording medium, not only a force in the conveyance direction but also a force in a direction opposite to the conveyance direction are exerted. Accordingly, load torque caused by the force in the direction opposite to the conveyance direction is exerted on the rotor 402 of the motor 509. As the deflection amount of the recording medium becomes larger, the load torque becomes larger. A following relationship is satisfied between the load torque and the current value iq.

$$Tm=iq*kt \tag{10}$$

Here, kt is a proportional coefficient representing a relationship between the load torque value Tm and the current value iq, which is specific to the motor.

As illustrated in FIG. 6, the current value iq of the thick paper and the current value iq of the plain paper increase after time t1. The increase of current indicates that the load torque on the rotor 402 increases. In other words, it is indicated that the side on the leading edge side of the recording medium abuts on the nip portion of the registration roller 308, and the recording medium starts to deflect at the time t1.

Further, as illustrated in FIG. 6, an increment of the current value iq per unit time of the thick paper is different from an increment of the current value iq per unit time of the plain paper. Specifically, the increment of the current value iq per unit time of the thick paper is greater than the increment of the current value iq per unit time of the plain paper. This is because an elastic force generated when the thick paper is deflected is greater than an elastic force generated when the plain paper is deflected. As described above, the current value iq in the period in which the recording medium is deflected differs depending on the sheet type. Therefore, if the current value iq in the period in which the recording medium is deflected is observed, the sheet type can be determined.

As illustrated in FIGS. 4 and 5, according to the present embodiment, the CPU 151*a* outputs an instruction (a determination instruction signal) to the sheet type determiner 200 to determine a sheet type. Specifically, the CPU 151*a* outputs a determination instruction signal to the sheet type determiner 200 when a predetermined time T2 elapses from the time t0. The predetermined time T2 corresponds to a time length from the time t0 to time t2. Further, the time t2 is a predetermined time in a period from the time t1 to the time t3 and includes the time t3. In other words, the predetermined time T2 is a time shorter than or equal to the predetermined time T1.

Figure 7:
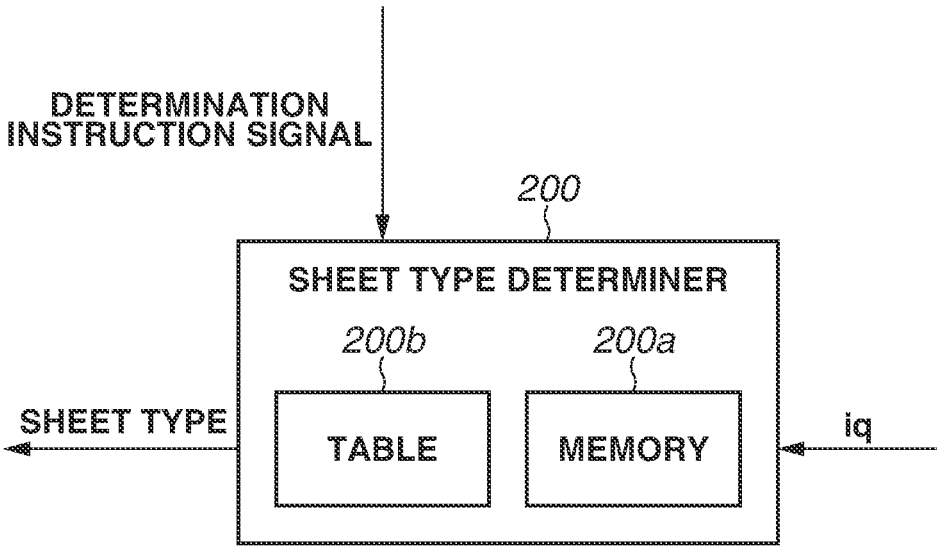
FIG. 7 is a block diagram illustrating a configuration of a sheet type determiner according to the first embodiment.

FIG. 7 is a block diagram illustrating an example of a configuration of the sheet type determiner 200. FIG. 8 is a table indicating a correspondence relationship between a sheet type and a current value iq at the time t2 according to the present embodiment. The current values iq indicated in FIG. 8 are values determined in advance by an experiment and the like. As illustrated in FIG. 7, the sheet type determiner 200 includes a memory 200*a* for storing the current value iq output from the coordinate converter 511. Further, the sheet type determiner 200 includes a table 200*b* illustrated in FIG. 8. The memory 200*a* according to the present embodiment updates the current value iq already stored in the memory 200*a* with a newly obtained current value iq.

When a determination instruction signal is input to the sheet type determiner 200, the sheet type determiner 200 obtains the current value iq which is first stored in the memory 200*a* after input of the determination instruction signal and determines the sheet type based on the obtained current value iq. Specifically, for example, when the current value iq is a value in a range of 0.5 to 0.7 A as illustrated in FIG. 8, the sheet type determiner 200 determines that a type of a recording medium being conveyed is plain paper. Further, when the current value iq is a value in a range of 1.0 to 1.2 A, the sheet type determiner 200 determines that a type of a recording medium being conveyed is thick paper. In other words, the sheet type determiner 200 determines that the recording medium is plain paper (a first sheet) when the current value iq is a value in the rage of 0.5 to 0.7 A (a first value) and determines that the recording medium is thick paper (a second sheet) of which a basis weight is greater than the plain paper when the current value iq is a value in the rage of 1.0 to 1.2 A (a second value). According to the present embodiment, when a determination instruction signal is input to the sheet type determiner 200, the sheet type determiner 200 determines the sheet type based on the current value iq first stored in the memory 200*a* after the input of the determination instruction signal, however, the present embodiment is not limited to this configuration. For example, the sheet type determiner 200 may obtain the current value iq already stored in the memory 200*a* when the determination instruction signal is input and determine the sheet type based on the obtained current value iq. Further, for example, the sheet type determiner 200 may be configured to, when the determination instruction signal is input from the CPU 151*a* to the sheet type determiner 200 at time t2-α and at the time t2, determine the sheet type based on an average value of the current value iq obtained at the time t2-α from the memory 200*a* and the current value iq obtained at the time t2 from the memory 200*a*.

The sheet type determiner 200 outputs information of the determined sheet type to the CPU 151*a*.

Figure 9:
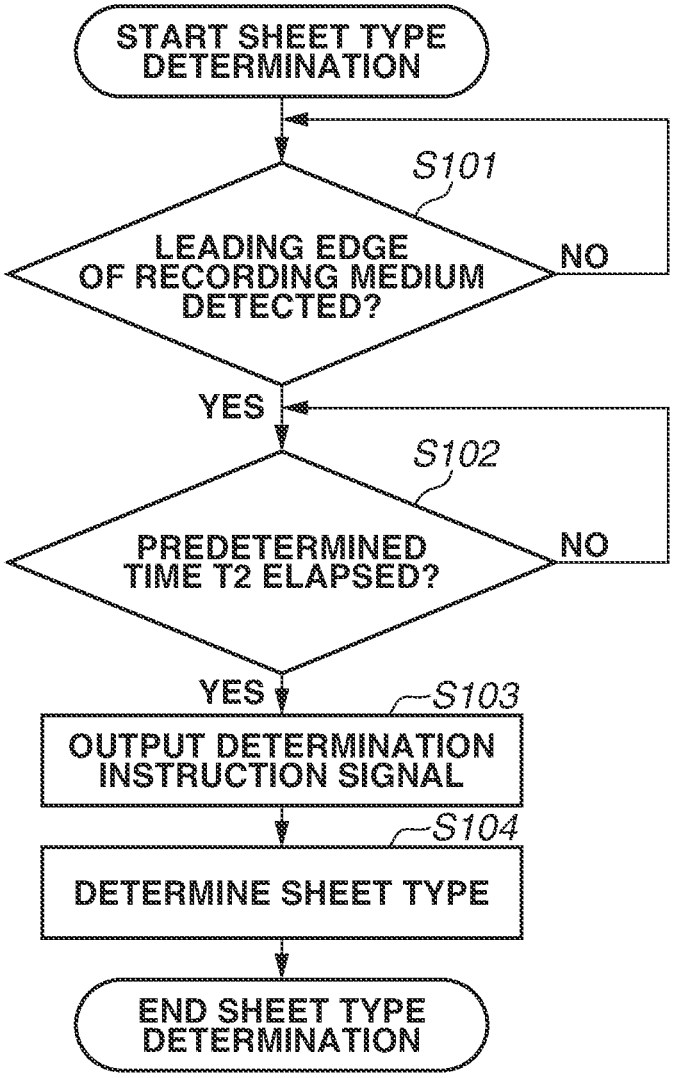
FIG. 9 is a flowchart illustrating a method for determining a sheet type according to the first embodiment.

FIG. 9 is a flowchart illustrating a method for determining a sheet type. The method for determining the sheet type according to the present embodiment is described below with reference to FIG. 9. The processing in the flowchart is executed by the CPU 151*a*.

First, when the CPU 151*a* outputs an enable signal 'H' to the motor control apparatus 157, the motor control apparatus 157 starts to control the motor 509 based on a command output from the CPU 151*a*.

In step S101, when the sheet sensor 328 detects the leading edge of the recording medium P (YES in step S101), the CPU 151*a* advances the processing to step S102.

In step S102, when the predetermined time T2 elapses from when the sheet sensor 328 detects the leading edge of the recording medium P (YES in step S102), then in step S103, the CPU 151*a* outputs a determination instruction signal to the sheet type determiner 200.

Subsequently, in step S104, the sheet type determiner 200 determines the sheet type based on the current value iq first stored in the memory 200*a* after the input of the determination instruction signal and outputs information of the sheet type to the CPU 151*a*.

As described above, according to the present embodiment, the sheet type is determined based on the current value iq in the period in which the recording medium is deflected. The load torque on the rotor of the motor differs depending on the sheet type. Specifically, for example, the load torque on the rotor when the thick paper is conveyed is greater than the load torque on the rotor when the plain paper is conveyed. The current value iq is a value corresponding to the load torque. Therefore, a type of a recording medium being conveyed can be determined by observing the current value iq. As described above, according to the present embodiment, the sheet type can be determined without using a sensor for determining the sheet type. Accordingly, the present embodiment can suppress the image forming apparatus from being enlarged or increasing in cost.

[Control of Image Forming Apparatus based on Sheet Type]

Next, an operation performed by the CPU 151*a* based on the information of the sheet type output from the sheet type determiner 200 is described.

Setting values such as voltages of the charger 310, the developing unit 314, the transfer charging device 315, and the like, and a temperature of the fixing heater 161 (hereinbelow, referred to as setting values) are set by the system controller 151. Specifically, the setting values set by the system controller 151 based on the information of the sheet type and the like transmitted to the system controller 151 by a user using the operation unit 152 are stored in the RAM 151*c*. The charger 310, the developing unit 314, the transfer charging device 315, and the fixing heater 161 are controlled based on the setting values stored in the RAM 151*c*.

However, when the information of the sheet type transmitted by the user to the system controller 151 is different from the type of the recording medium to be actually used, there is a possibility that image forming cannot be appropriately performed by the setting values set in advance. For example, an image quality may be deteriorated by shortage of a transfer voltage, and toner may peel off due to an insufficient fixing temperature.

According to the present embodiment, the system controller 151 (the CPU 151*a*) stores the setting values set based on the information of the sheet type determined by the sheet type determiner 200 in the RAM 151*c*.

Figure 10:
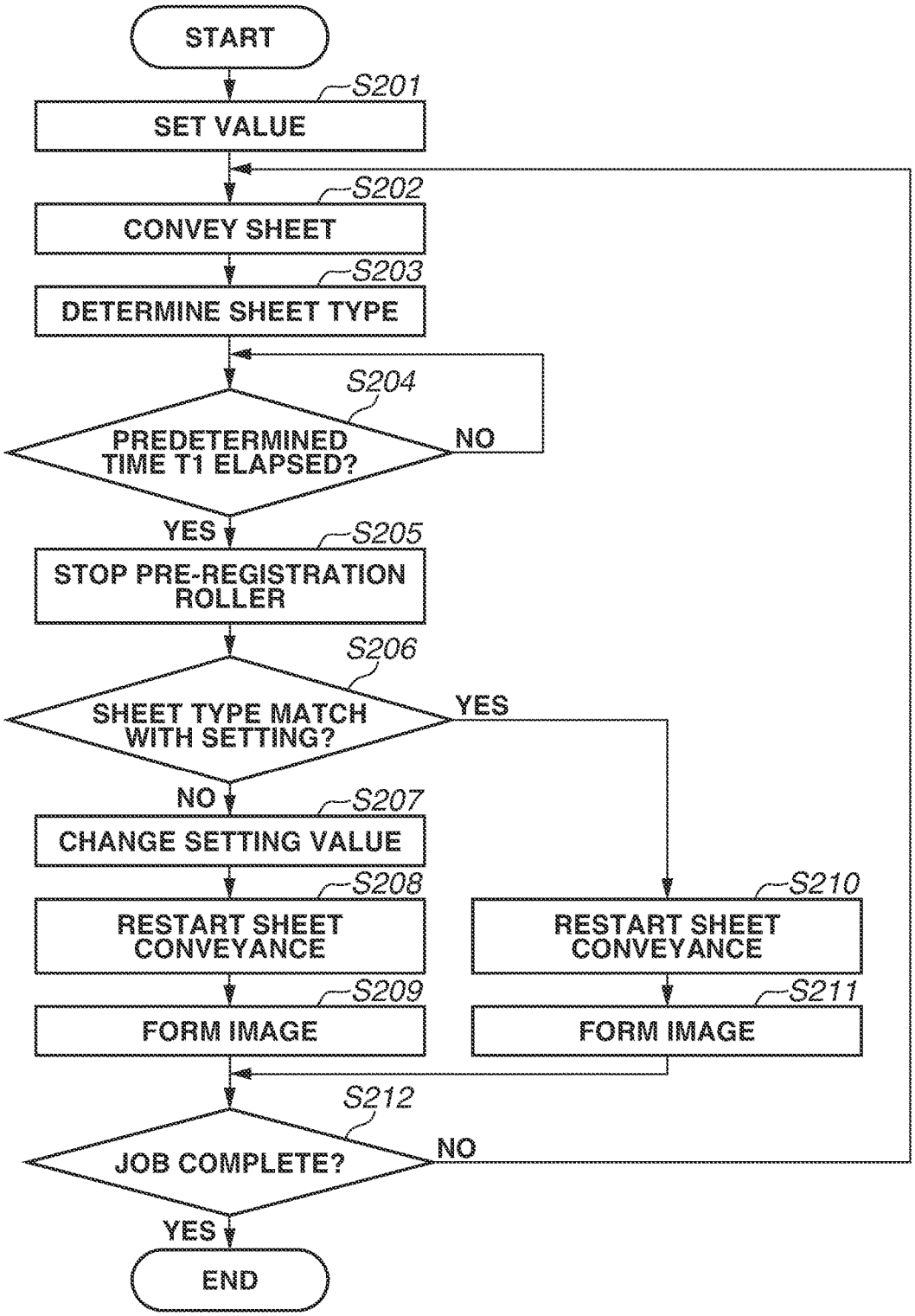
FIG. 10 is a flowchart illustrating a method for setting a setting value by a central processing unit (CPU) based on information of a sheet type output from the sheet type determiner according to the first embodiment.

FIG. 10 is a flowchart illustrating a method for setting the setting value by the CPU 151*a* based on the information of the sheet type output from the sheet type determiner 200. The method for setting the setting value according to the present embodiment is described below with reference to FIG. 10. The processing in the flowchart is executed by the CPU 151*a*.

First, in step S201, the CPU 151*a* stores setting values set based on the information of the sheet type and the like set by a user in the RAM 151*c*.

Subsequently, in step S202, the CPU 151*a* outputs an enable signal 'H' to the motor control apparatus for controlling the motor driving various rollers, and the motor control apparatus starts to control the motor based on a command output from the CPU 151*a*. Accordingly, conveyance of a recording medium is started.

Next, in step S203, the sheet type determiner 200 determines the sheet type using the above-described method and outputs the information of the sheet type to the CPU 151*a*.

In step S204, when the predetermined time T1 elapses from when the sheet sensor 328 detects the leading edge of the recording medium P (YES in step S204), then in step S205, the CPU 151*a* controls the motor control apparatus 157 to stop rotation of the motor 509. Accordingly, rotation of the pre-registration roller 327 is stopped.

Subsequently, in step S206, the CPU 151*a* determines whether the sheet type set by the user matches with the sheet type determined by the sheet type determiner 200. When the sheet type set by the user does not match with the sheet type determined by the sheet type determiner 200 (NO in step S206), then in step S207, the CPU 151*a* updates (changes) the setting value stored in the RAM 151*c* based on the information of the sheet type determined by the sheet type determiner 200. Specifically, for example, when the sheet type set by the user is plain paper, and the sheet type determined by the sheet type determiner 200 is thick paper, the CPU 151*a* sets a voltage of the transfer charging device 315 higher than the voltage set in step S201. More specifically, for example, the CPU 151*a* changes the voltage of 500 V corresponding to plain paper to a voltage of 1300 V corresponding to thick paper. This is because that as paper is thicker, a voltage necessary for transferring an image on a sheet is higher. As described above, the CPU 151*a* updates the setting value stored in the RAM 151*c* based on the information of the sheet type determined by the sheet type determiner 200. In the RAM 151*c*, data indicating a correspondence relationship between a sheet type and the setting value is stored, and the CPU 151*a* changes the setting value based on the relevant data.

Next, in step S208, the CPU 151*a* controls the motor control apparatus 157 to restart the control of the motor 509. Accordingly, the conveyance of the recording medium is restarted. Subsequently, in step S209, the image forming apparatus 100 forms an image on the recording medium based on the setting value stored in the RAM 151*c*, and the CPU 151*a* advances the processing to step S212.

In step S206, when the sheet type set by the user matches with the sheet type determined by the sheet type determiner 200 (YES in step S206), then in step S210, the CPU 151*a* controls the motor control apparatus 157 to restart the control of the motor 509. Accordingly, the conveyance of the recording medium is restarted. Subsequently, in step S211, the image forming apparatus 100 forms an image on the recording medium, and the CPU 151*a* advances the processing to step S212.

Subsequently, the CPU 151*a* repeats the above-described processing until the image forming job is complete.

As described above, according to the present embodiment, when the sheet type set by the user does not match with the sheet type determined by the sheet type determiner 200, the CPU 151*a* updates the setting value stored in the RAM 151*c* based on the information of the sheet type determined by the sheet type determiner 200. Further, when the sheet type set by the user matches with the sheet type determined by the sheet type determiner 200, the CPU 151*a* does not change the setting value. In other words, the image forming apparatus 100 performs image forming in a state in which the setting value is set to a value suitable for the sheet type. Accordingly, the image forming apparatus 100 can suppress an image quality from being deteriorated by shortage of a transfer voltage and toner from peeling off due to an insufficient fixing temperature. The setting value includes a conveyance speed for conveying a sheet and, for example, a conveyance speed in the case of thick paper is slower than a conveyance speed in the case of plain paper.

According to the present embodiment, the time t2 is the predetermined time in the period from the time t1 to the time t3, however, it is preferable to set the time t2 to a time as close as possible to the time t3 in order to accurately determine the sheet type. This is because that, as illustrated in FIG. 6, as the time is closer to the time t3, a difference between the current value iq of the thick paper and the current value iq of the plain paper is greater.

According to a second embodiment, configurations of the image forming apparatus and the motor control apparatus are similar to those of the first embodiment, and thus the description thereof is omitted. Further, the operation performed by the CPU 151*a* based on the information of the sheet type output from the sheet type determiner 200 is similar to that of the first embodiment, and thus the description thereof is omitted.

According to the second embodiment, the sheet type determiner 200 determines a sheet type based on a change amount (slope) of the current value iq per unit time in a period in which a recording medium is deflected by the pre-registration roller 327.

Figure 11:
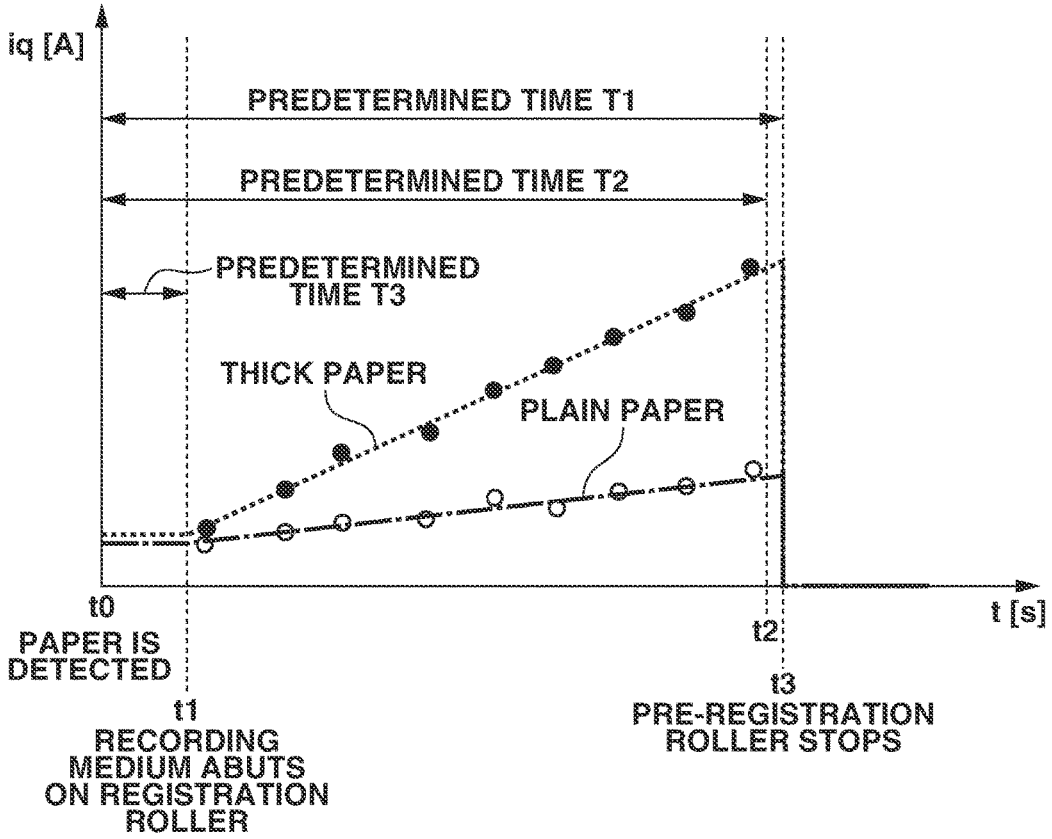
FIG. 11 illustrates a change of a current value iq in a process for correcting skew feeding according to a second embodiment.

A method for determining the sheet type according to the present embodiment is described below. FIG. 11 illustrates a change of the current value iq in a process for correcting skew feeding according to the present embodiment. FIG. 11 illustrates the current values iq (black circles) when skew feeding correction is performed on thick paper and the current values iq (white circles) when skew feeding correction is performed on plain paper. In addition, a dotted line in FIG. 11 is a line obtained by linearly approximating the current values iq when skew feeding correction is performed on thick paper, and an alternate long and short dash line in FIG. 11 is a line obtained by linearly approximating the current values iq when skew feeding correction is performed on plain paper. The predetermined times T1 and T2 and the times t0 to t3 are similar to those in the first embodiment, and thus the description thereof is omitted.

As illustrated in FIG. 11, the change amount of the current value iq per unit time of the thick paper is different from the change amount of the current value iq per unit time of the plain paper. Specifically, an increment of the current value iq per unit time of the thick paper is greater than an increment of the current value iq per unit time of the plain paper. This is because an elastic force generated on the thick paper in a period in which the thick paper is deflected is greater than an elastic force generated on the plain paper in a period in which the plain paper is deflected. As described above, an increment of a current value iq per unit time in a period in which a recording medium is deflected differs depending on a sheet type. Therefore, a sheet type can be determined by observing a change amount of current value iq per unit time in a period in which a recording medium is deflected.

Similar to the first embodiment, the CPU 151*a* outputs an instruction (a determination instruction signal) to the sheet type determiner 200 to determine a sheet type according to the present embodiment. Specifically, the CPU 151*a* outputs the determination instruction signal to the sheet type determiner 200 when the predetermined time T2 elapses from the time t0.

Figure 12:
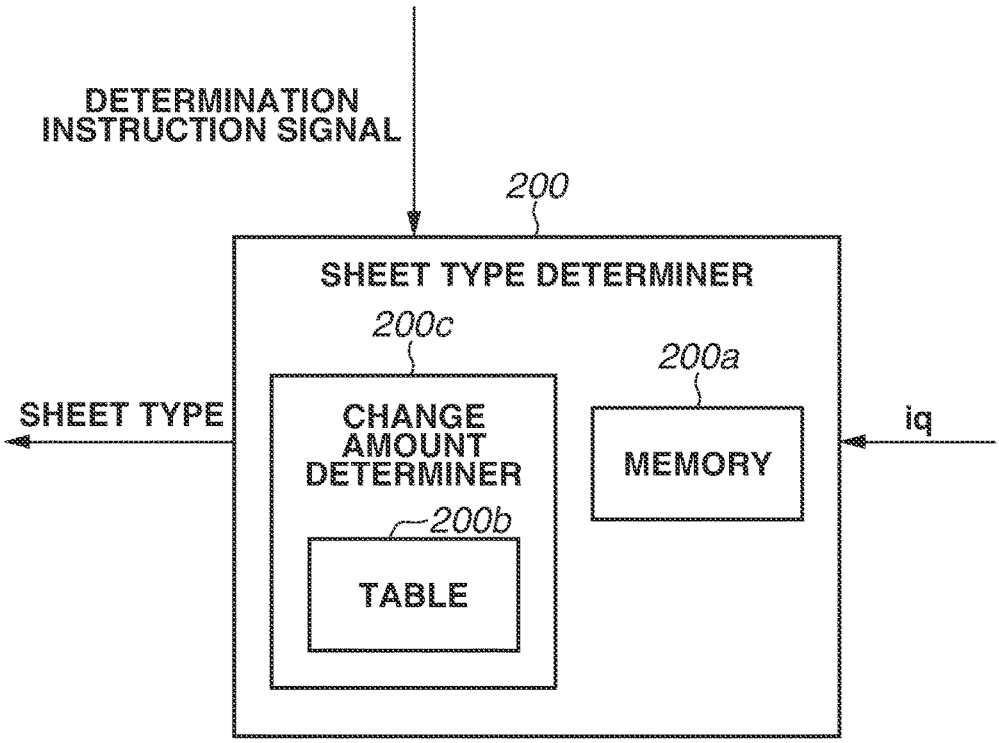
FIG. 12 is a block diagram illustrating a configuration of a sheet type determiner according to the second embodiment.

FIG. 12 is a block diagram illustrating an example of a configuration of the sheet type determiner 200 according to the present embodiment. FIG. 13 is a table indicating a correspondence relationship between a sheet type and a change amount Δiq of current value iq per unit time according to the present embodiment. As illustrated in FIG. 12, the sheet type determiner 200 according to the present embodiment includes the memory 200*a* which obtains the current values iq output from the coordinate converter 511 at different timings and stores a plurality of the current values iq by associating with time t at which the respective current values iq are obtained. In addition, the sheet type determiner 200 includes a change amount determiner 200*c* for determining the change amount Δiq per unit time by linearly approximating the current values iq stored in the memory 200*a*. Further, the change amount determiner 200*c* includes the table 200*b* illustrated in FIG. 13.

When a determination instruction signal is input, the change amount determiner 200*c* linearly approximates all of the current values iq stored in the memory 200*a* in a period from the time t1 to the time t2 and determines the change amount Δiq per unit time. Further, the change amount determiner 200*c* determines a sheet type based on the change amount Δiq per unit time. Specifically, for example, when the change amount Δiq is a value in a range of 2 to 4 A/s as illustrated in FIG. 13, the change amount determiner 200*c* determines that a type of a recording medium being conveyed is plain paper. Further, when the change amount Δiq is a value in a range of 10 to 12 A/s, the change amount determiner 200*c* determines that a type of a recording medium being conveyed is thick paper. In other words, the sheet type determiner 200 determines that the recording medium is plain paper (a first sheet) when the change amount Δiq is a value in the rage of 2 to 4 A/s (a first value) and determines that the recording medium is thick paper (a second sheet) of which stiffness is greater than the plain paper when the change amount Δiq is a value in the rage of 10 to 12 A/s (a second value). The sheet type determiner 200 outputs information of the determined sheet type to the CPU 151*a*. The time t1 is a time that a predetermined time T3 elapses from the time t0, and the predetermined time T3 is determined by a control sequence of the motor set in advance. According to the present embodiment, the memory 200*a* deletes the stored current value iq when outputting the information of the sheet type determined by the sheet type determiner 200 to the CPU 151*a*. The correspondence relationship between the sheet type and the change amount Δiq is a value determined in advance by an experiment and the like.

Figure 14:
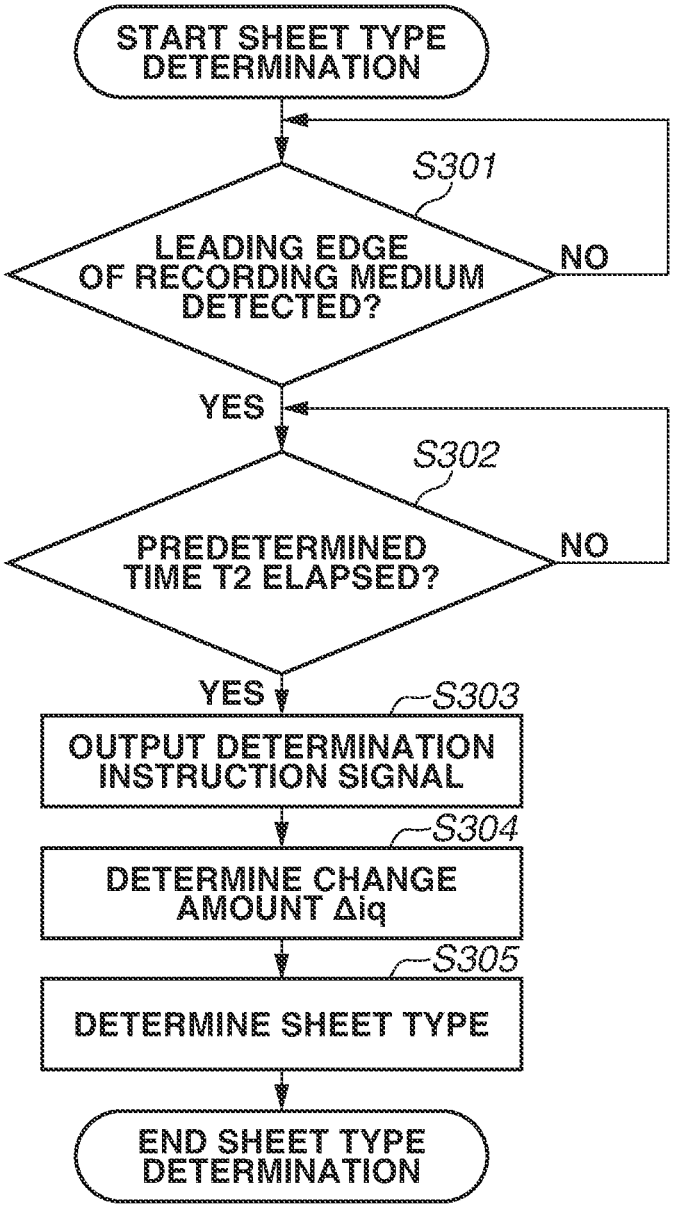
FIG. 14 is a flowchart illustrating a method for determining a sheet type according to the second embodiment.

FIG. 14 is a flowchart illustrating a method for determining the sheet type. The method for determining the sheet type according to the present embodiment is described below with reference to FIG. 14. The processing in the flowchart is executed by the CPU 151*a*.

First, when the CPU 151*a* outputs an enable signal 'H' to the motor control apparatus 157, the motor control apparatus 157 starts to control of driving of the motor 509 based on a command output from the CPU 151*a*.

In step S301, when the sheet sensor 328 detects the leading edge of the recording medium P (YES in step S301), the CPU 151*a* advances the processing to step S302.

In step S302, when the predetermined time T2 elapses from when the sheet sensor 328 detects the leading edge of the recording medium P (YES in step S302), then in step S303, the CPU 151*a* outputs a determination instruction signal to the sheet type determiner 200.

Subsequently, in step S304, the change amount determiner 200*c* determines the change amount Δiq of the current value iq per unit time in a period from the time t1 to the time t2 stored in the memory 200*a*.

In step S305, the sheet type determiner 200 determines the sheet type based on the change amount Δiq and outputs information of the sheet type to the CPU 151*a*.

As described above, according to the present embodiment, the sheet type is determined based on a change amount (slope) of the current value iq per unit time in a period in which the recording medium is deflected. Accordingly, the sheet type can be determined without using a sensor for determining the sheet type. Accordingly, the present embodiment can suppress the image forming apparatus from being enlarged or increasing in cost.

According to the present embodiment, the time t2 is the predetermined time in the period from the time t1 to the time t3, however, it is preferable to set the time t2 to a time as close as possible to the time t3 in order to accurately determine the sheet type. This is because that, as the time t2 is closer to the time t3, more data pieces of the q axis current values are obtained, and accuracy for determining the change amount Δiq is refined.

According to the present embodiment, the change amount Δiq is determined by linearly approximating all of the q axis current values stored in the memory 200*a* in the period from the time t1 to the time t2, however, the present embodiment is not limited to this configuration. For example, the change amount Δiq may be determined by linearly approximating two or more q axis current values in the period from the time t1 to the time t2. In other words, a configuration may be adopted which does not use all q axis current values to determine a sheet type.

According to a third embodiment, configurations of the image forming apparatus and the motor control apparatus are similar to those of the first embodiment, and thus the description thereof is omitted.

According to the first and the second embodiments, a sheet type is determined based on current values iq in a period in which a recording medium is deflected between the pre-registration roller 327 and the registration roller 308. According to the present embodiment, a recording medium is conveyed in a bent conveyance path, and a sheet type is determined based on current values iq in a period in which the recording medium is deflected in the bent conveyance path.

Figure 15:
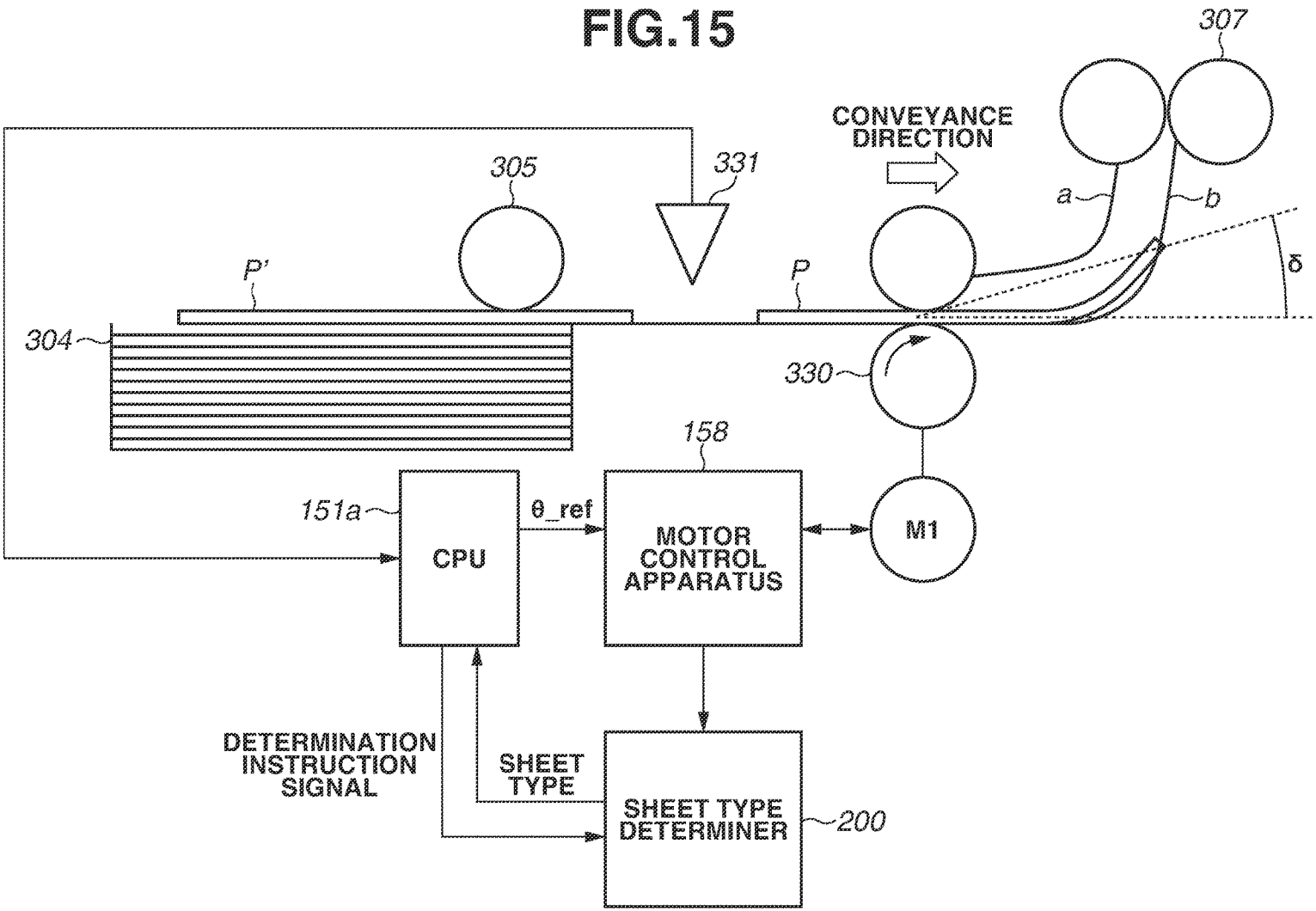
FIG. 15 illustrates a conveyance path formed between conveyance rollers.

FIG. 15 illustrates a conveyance path formed between the conveyance roller 330 and the conveyance roller 307. As illustrated in FIG. 15, the conveyance path formed between the conveyance roller 330 and the conveyance roller 307 is formed by a conveyance guide a and a conveyance guide b. A shape of the conveyance path formed by the conveyance guide a and the conveyance guide b is an example of the bent conveyance path, and the shape of the conveyance path (a bend angle of the conveyance path, a distance between the guide a and the guide b, and the like) is not limited to the above-described one.

As illustrated in FIG. 15, the conveyance roller 330 is driven by a motor M1, and the motor M1 is controlled by a motor control apparatus 158. The motor control apparatus 158 is connected to the CPU 151*a* (the system controller 151) and controls the motor M1 based on a command from the CPU 151*a*. A configuration of the motor control apparatus 158 is similar to that of the motor control apparatus 157, and thus the description thereof is omitted.

As illustrated in FIG. 15, a sheet sensor 331 for detecting existence of a recording medium is installed between a feeding roller 305 and the conveyance roller 330. The sheet sensor 331 is connected to the CPU 151*a* (the system controller 151), and the CPU 151*a* outputs a determination instruction signal to the sheet type determiner 200 based on detection of a leading edge of a recording medium by the sheet sensor 331.

A recording medium conveyed by the conveyance roller 330 is conveyed while abutting on the bent conveyance path. When the recording medium is conveyed while abutting on the bent conveyance path, a frictional force is exerted on the recording medium in a direction opposite to the conveyance direction by friction between the recording medium and the conveyance path. The frictional force generated by friction between the recording medium and the conveyance path becomes greater as a coefficient of friction of a surface of the recording medium conveyed is greater. In other words, load torque on the conveyance roller 330 becomes greater as the coefficient of friction of the surface of the recording medium conveyed is greater.

Further, when the recording medium is conveyed while abutting on the bent conveyance path, the recording medium is conveyed in a deflected state. In this regard, as an angle δ formed by a straight line connecting a nip portion of the conveyance roller 330 and a leading edge of a recording medium and a horizontal direction illustrated in FIG. 15 is greater, a deflection amount of the recording medium becomes greater. As described in the first to the third embodiments, when the deflection amount of the recording medium is increased, an elastic force exerted on the recording medium also is increased. In other words, when the deflection amount of the recording medium is increased, the load torque on the conveyance roller 330 also is increased. An increment (a change amount) of the load torque becomes greater as stiffness (a basis weight) of the recording medium is greater. In other words, the change amount of the load torque when the deflection amount of the thick paper is increased is larger than the change amount of the load torque when a deflection amount of the plain paper is increased.

Figure 16:
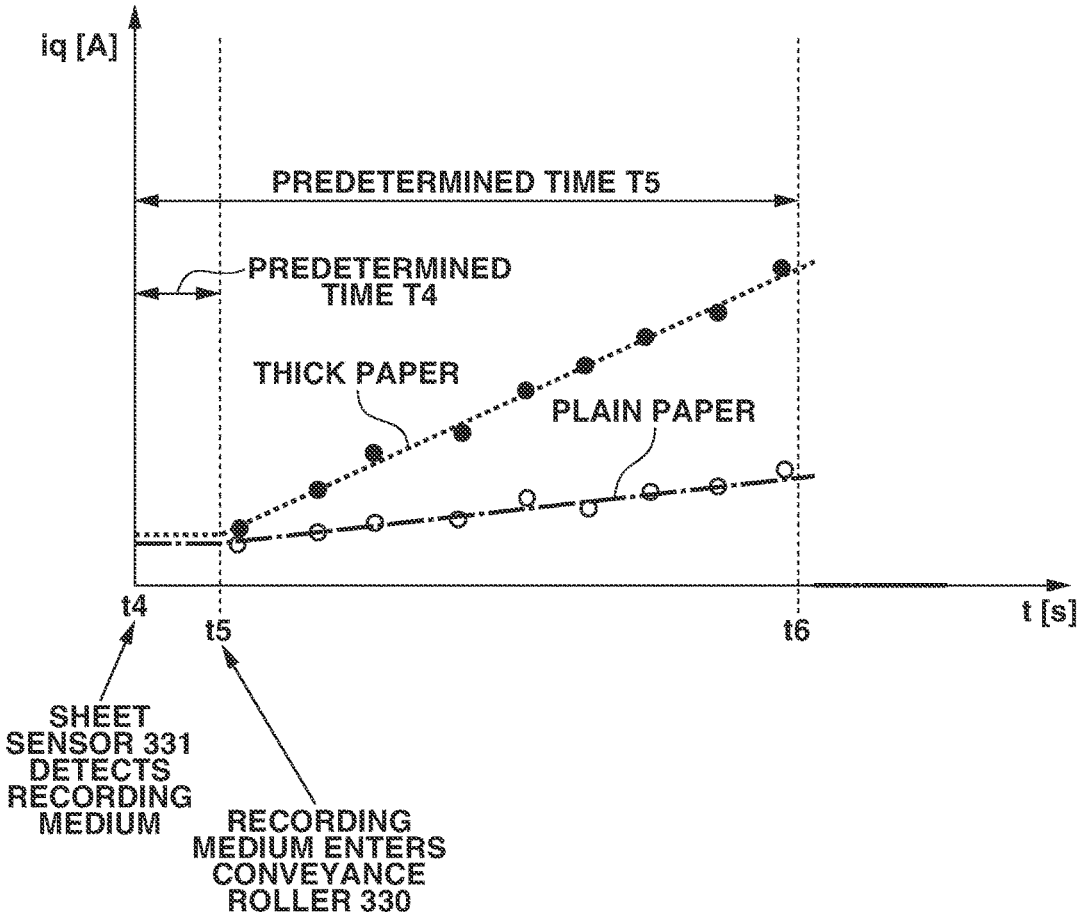
FIG. 16 illustrates a change of a current value iq in a period in which a recording medium is conveyed in a bent conveyance path.

A method for determining the sheet type according to the present embodiment is described below. FIG. 16 illustrates a change of the current value iq in a period in which a recording medium is conveyed in a bent conveyance path. FIG. 16 illustrates the current values iq (black circles) when thick paper is conveyed and the current values iq (white circles) when plain paper is conveyed. In addition, a dotted line in FIG. 16 is a line obtained by linearly approximating the current values iq when thick paper is conveyed, and an alternate long and short dash line in FIG. 16 is a line obtained by linearly approximating the current values iq when plain paper is conveyed.

According to the present embodiment, the CPU 151*a* outputs a determination instruction signal to the sheet type determiner 200 at a time t6 when a predetermined time T5 elapses from a time t4 at which the sheet sensor 331 detects a recording medium. The time t6 is a time later than a time t5 when a predetermined time T4 elapses from the time t4 and set to a time before a timing at which the leading edge of the recording medium reaches a nip portion of the conveyance roller 307. The predetermined time T4 is set based on the control sequence of the motor set in advance.

Figure 17:
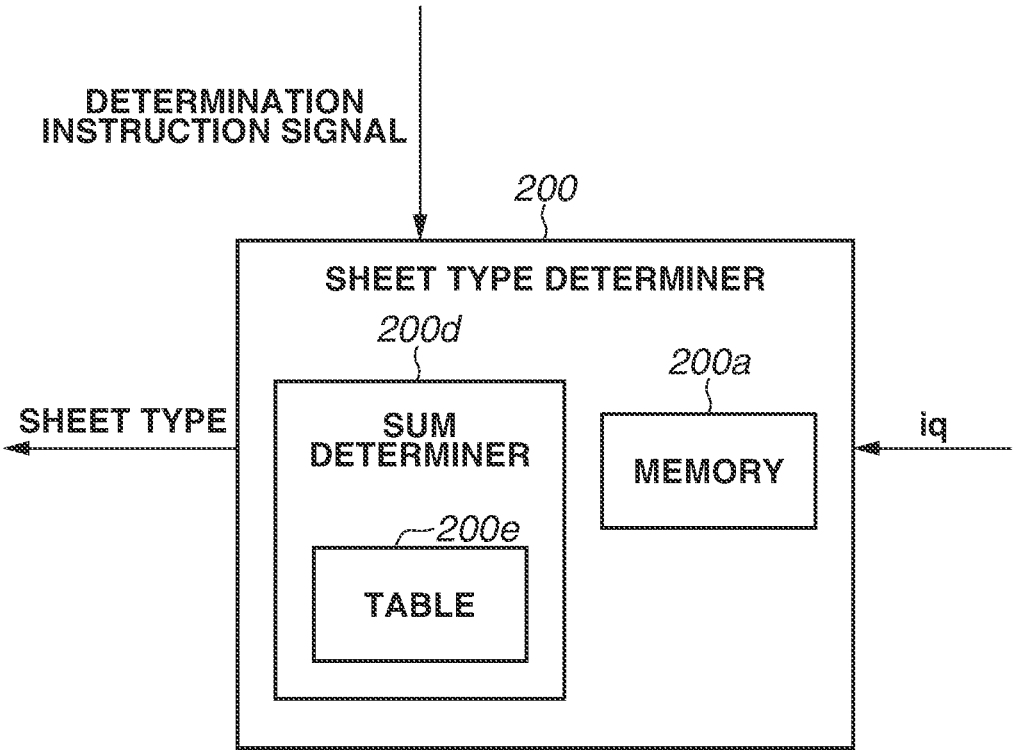
FIG. 17 is a block diagram illustrating a configuration of a sheet type determiner according to a third embodiment.

FIG. 17 is a block diagram illustrating an example of a configuration of the sheet type determiner 200 according to the present embodiment. As illustrated in FIG. 17, the sheet type determiner 200 according to the present embodiment includes the memory 200*a* which obtains the current values iq output from the coordinate converter 511 at different timings and stores a plurality of the current values iq by associating with time t at which the respective current values iq are obtained. In addition, the sheet type determiner 200 includes a sum determiner 200*d* for linearly approximating the current values iq stored in the memory 200*a* and determining a sum Σiq of the current values iq based on a linear approximation formula. A sum (an integrated value) of the current values iq corresponds to an area surrounded by a linearly approximated line and an abscissa (an axis indicating time t) in a period from the time t5 to the time t6 in FIG. 16.

When a determination instruction signal is input, the sum determiner 200*d* linearly approximates all of the current values iq stored in the memory 200*a* in the period from the time t5 to the time t6 and determines the sum Σiq of the current values iq in the period from the time t5 to the time t6 based on the linear approximation formula.

FIG. 18 is a table indicating a correspondence relationship between a sheet type and a sum Σiq of current values iq according to the present embodiment. As illustrated in FIG. 17, the sum determiner 200*d* includes a table 200*e* illustrated in FIG. 18.

The sum determiner 200*d* (the sheet type determiner 200) determines that a type of a recording medium being conveyed is plain paper when the sum Σiq is a value in a range of 8 to 12 A as illustrated in FIG. 18. Further, when the sum Σiq is a value in a range of 15 to 20 A, the sheet type determiner 200 determines that a type of a recording medium being conveyed is thick paper. In other words, the sheet type determiner 200 determines that the recording medium is plain paper (a first sheet) when the sum Σiq is a value in the range of 8 to 12 A (a first value) and determines that the recording medium is thick paper (a second sheet) of which stiffness is greater than the plain paper when the sum Σiq is a value in the rage of 15 to 20 A (a second value). The sheet type determiner 200 outputs information of the determined sheet type to the CPU 151*a*. According to the present embodiment, the memory 200*a* deletes the stored current value iq when outputting the information of the sheet type determined by the sheet type determiner 200 to the CPU 151*a*. The correspondence relationship between the sheet type and the sum Σiq is a value determined in advance by an experiment and the like.

Figure 19:
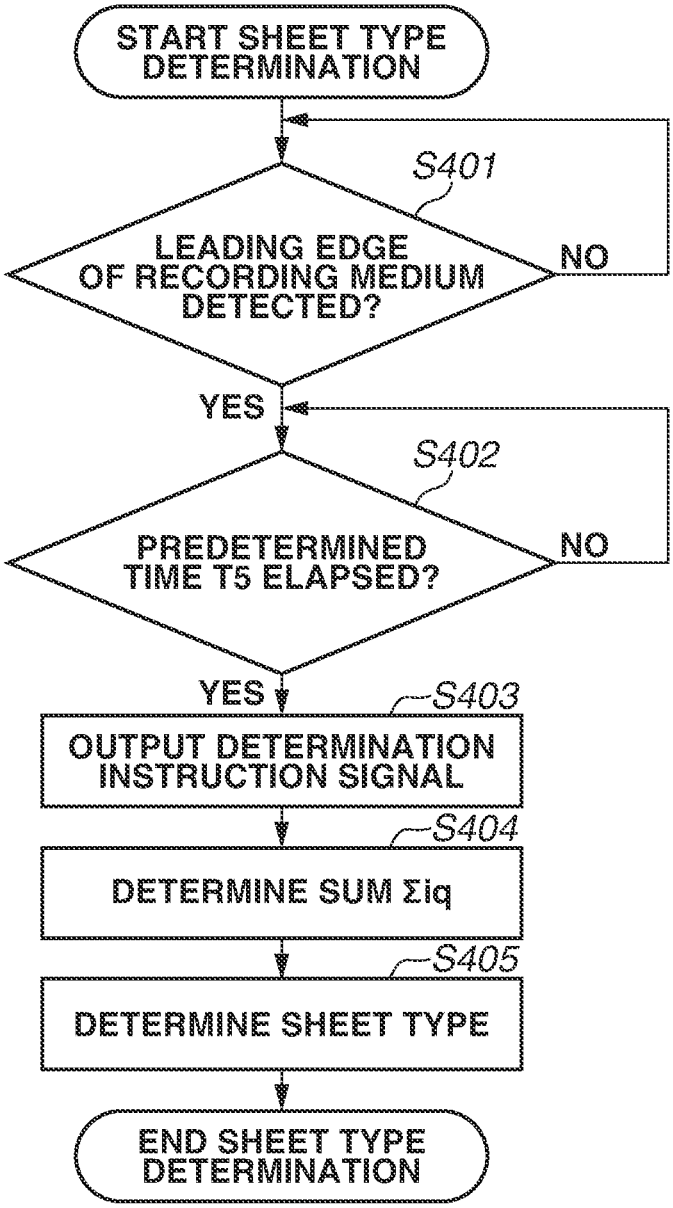
FIG. 19 is a flowchart illustrating a method for determining a sheet type according to the third embodiment.

FIG. 19 is a flowchart illustrating a method for determining the sheet type. The method for determining the sheet type according to the present embodiment is described below with reference to FIG. 19. The processing in the flowchart is executed by the CPU 151*a*.

First, when the CPU 151*a* outputs an enable signal 'H' to the motor control apparatus 157, the motor control apparatus 157 starts to control the motor 509 based on a command output from the CPU 151*a*.

In step S401, when the sheet sensor 331 detects a leading edge of the recording medium P (YES in step S401), the CPU 151*a* advances the processing to step S402.

In step S402, when the predetermined time T5 elapses from when the sheet sensor 331 detects the leading edge of the recording medium P (YES in step S402), then in step S403, the CPU 151*a* outputs a determination instruction signal to the sheet type determiner 200.

Subsequently, in step S404, the sum determiner 200*d* linearly approximates the current values iq in the period from the time t5 to the time t6 stored in the memory 200*a* and determines the sum Σiq of the current values iq in the period from the time t5 to the time t6 based on the linear approximation formula.

In step S405, the sheet type determiner 200 determines the sheet type based on the sum Σiq and outputs information of the sheet type to the CPU 151*a*.

[Control of Image Forming Apparatus based on Sheet Type]

Next, an operation performed by the CPU 151*a* based on the information of the sheet type output from the sheet type determiner 200 is described.

Figure 20:
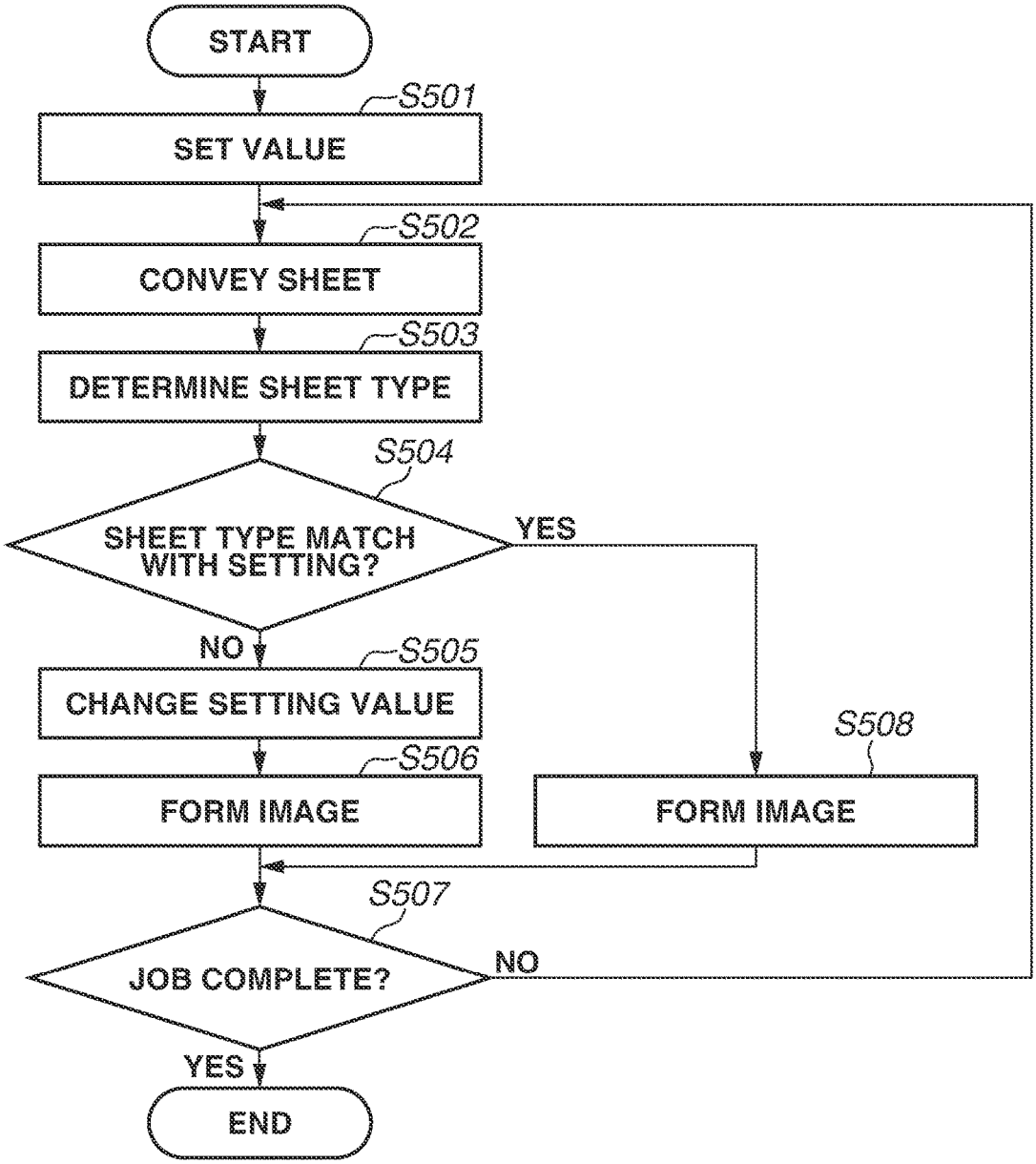
FIG. 20 is a flowchart illustrating a method for setting a setting value by a CPU based on information of a sheet type output from the sheet type determiner according to the third embodiment.

FIG. 20 is a flowchart illustrating a method for setting the setting value by the CPU 151*a* based on the information of the sheet type output from the sheet type determiner 200. The method for setting the setting value according to the present embodiment is described below with reference to FIG. 20. The processing in the flowchart is executed by the CPU 151*a*.

The processing in steps S501 to S503 is similar to that in steps S201 to S203 in FIG. 10, and thus the description thereof is omitted. In addition, the processing in steps S504 and S505 is similar to that in steps S206 and S207 in FIG. 10, and thus the description thereof is omitted.

In step S506, the image forming apparatus 100 forms an image on the recording medium based on the setting value stored in the RAM 151*c*, and the CPU 151*a* advances the processing to step S507.

In step S504, when the sheet type set by the user matches with the sheet type determined by the sheet type determiner 200 (YES in step S504), then in step S508, the image forming apparatus 100 forms an image on the recording medium based on the setting value stored in the RAM 151*c*, and the CPU 151*a* advances the processing to S507.

Subsequently, the CPU 151*a* repeats the above-described processing until the image forming job is complete.

As described above, according to the present embodiment, a recording medium is conveyed in a bent conveyance path, and a sheet type is determined based on current values iq in a period in which the recording medium is deflected in the bent conveyance path. Specifically, the sheet type is determined based on the sum of the current values iq in the period in which the recording medium passes through the bent conveyance path. Accordingly, the sheet type can be determined without using a sensor for determining the sheet type. Accordingly, the present embodiment can suppress the image forming apparatus from being enlarged or increasing in cost.

In addition, the sheet type determined by the sheet type determiner 200 is compared with the sheet type set by the user without stopping conveyance of the recording medium. When the sheet type set by the user does not match with the sheet type determined by the sheet type determiner 200, the CPU 151*a* updates the setting value stored in the RAM 151*c* based on the information of the sheet type determined by the sheet type determiner 200. Further, when the sheet type set by the user matches with the sheet type determined by the sheet type determiner 200, the CPU 151*a* does not change the setting value. As described above, the image forming apparatus 100 can perform image forming in a state in which the setting value is set to a value suitable for the sheet type without stopping conveyance of the recording medium. Accordingly, the image forming apparatus 100 can suppress image forming from being delayed due to a stoppage of conveyance of the recording medium. Further, the image forming apparatus 100 can suppress an image quality from being deteriorated by shortage of a transfer voltage and toner from peeling off due to an insufficient fixing temperature. The setting value includes a conveyance speed for conveying a sheet and, for example, a conveyance speed in the case of thick paper is slower than a conveyance speed in the case of plain paper.

As described above, according to the first to the third embodiments, a sheet type is determined based on a current value iq of a sheet in a deflected state in which the sheet is conveyed by an upstream conveyance roller and not conveyed by a downstream conveyance roller in the conveyance rollers adjacent to each other.

According to the present embodiment, a sheet type is determined when a recording medium first passes through the bent conveyance path after the recording medium is fed, so that the CPU 151*a* can change the setting value without stopping conveyance of the recording medium.

Further, according to the present embodiment, in the case that a sheet type is determined when the recording medium passes through the bent conveyance path, the sheet type is determined based on current values iq in a period from when a leading edge of the recording medium passes through a nip portion of the conveyance roller 330 to when the leading edge reaches a nip portion of the conveyance roller 307. This is because when the recording medium is conveyed by the conveyance roller 307, an elastic force generated on the recording medium is reduced, and the load torque on the rotor of the motor M1 may be reduced.

According to the present embodiment, the sum determiner 200*d* determines the sum Σiq of the current values iq in the period from the time t5 to the time t6, however, the present embodiment is not limited to this configuration. For example, the sum determiner 200*d* may have a configuration which determines a sum Σiq of current values iq in a predetermined period in the period from the time t5 to the time t6.

The configuration described in the present embodiment, in other words, the configuration for determining a sheet type based on a sum Σiq may be applied to a period in which skew feeding correction is performed.

The configuration for determining a sheet type based on a current value iq at a predetermined timing which is described in the first embodiment may be applied to the method for determining a type of a recording medium passing through a bent conveyance path. Further, the configuration for determining a sheet type based on a change amount of a current value iq which is described in the second embodiment may be applied to the method for determining a type of a recording medium passing through a bent conveyance path.

Information of a sheet type according to the first to the third embodiments includes a basis weight of a sheet and the like.

Further, according to the first to the third embodiments, the sheet type determiner 200 determines a sheet type, however, the CPU 151*a* may perform the above-described determination of sheet type. In other words, the CPU 151*a* may have a function of the sheet type determiner 200.

According to the first and the second embodiments, a leading edge of a recording medium abuts on the nip portion of the registration roller 308, and thus skew feeding correction of the recording medium is performed, however, the embodiments are not limited to this configuration. For example, a shutter as an abutment member on which a leading edge of a recording medium abuts on may be installed on an upstream side of the registration roller 308 and a downstream side of the sheet sensor 328 or on an upstream side of the transfer position and a downstream side of the registration roller 308 in the conveyance direction of a recording medium. Further, a leading edge of a recording medium abuts on the shutter, and skew feeding correction of the recording medium is performed by the above-described method. Subsequently, the shutter may be retracted when the registration roller 308 conveys the recording medium to the transfer position at the same timing with a toner image.

According to the first and the second embodiments, a sheet type is determined based on a current value iq, however, load torque Tm on the rotor may be used. In other words, the load torque Tm may be determined from the q axis current value based on the formula (10), and a sheet type may be determined based on the load torque Tm. Further, when the load torque Tm is determined, for example, a load torque value Tm may be determined from a deviation between the rotation phase θ and the command phase θ_ref of the rotor instead of the current value iq. Furthermore, a table indicating a relationship between the load torque value Tm and the current value iq may be stored in advance in the ROM 151*b* and the like, and the load torque value Tm corresponding to the current value iq may be read from the ROM 151*b* based on the relevant table.

According to the first to the third embodiments, a stepping motor is used as a motor for driving the pre-registration roller 327, however, another motor such as a direct-current (DC) motor may be used. Further, the first to the third embodiments can be applied to a motor not only a two-phase motor but also a three-phase motor and other motors.

According to the first to the third embodiments, a permanent magnet is used as the rotor, however, the embodiments are not limited to this configuration.

According to the first to the third embodiments, when the sheet type set by the user does not match with the sheet type determined by the sheet type determiner 200, the CPU 151*a* sets the setting value based on the sheet type determined by the sheet type determiner 200, however, the embodiments are not limited to this configuration. For example, when the sheet type set by the user does not match with the sheet type determined by the sheet type determiner 200, the CPU 151*a* may notify a user to change a sheet type to be set via the display unit provided in the operation unit 152. Accordingly, the user changes the setting of the sheet type, and the CPU 151*a* sets the setting value based on the sheet type changed by the user. Accordingly, the image forming apparatus 100 can perform image forming in a state in which the setting value is set to a value suitable for the sheet type. In other words, the image forming apparatus 100 can suppress an image quality from being deteriorated by shortage of a transfer voltage and toner from peeling off due to an insufficient fixing temperature. Further, for example, when the current value iq, the change amount Δiq, and the sum Σiq do not match with information stored in the tables, the CPU 151*a* may notify a user to check the set sheet type via the display unit provided in the operation unit 152. A case that the current value iq does not match with the information stored in the table is, for example, a case when the current value iq is 1.5 A and the like (see FIG. 8). Further, a case that the change amount Δiq does not match with the information stored in the table is, for example, a case when the change amount Δiq is 15 A/s and the like (see FIG. 13). Furthermore, a case that the sum Σiq does not match with the information stored in the table is, for example, a case when the sum Σiq is 25 A and the like (see FIG. 18).

Figure 21:
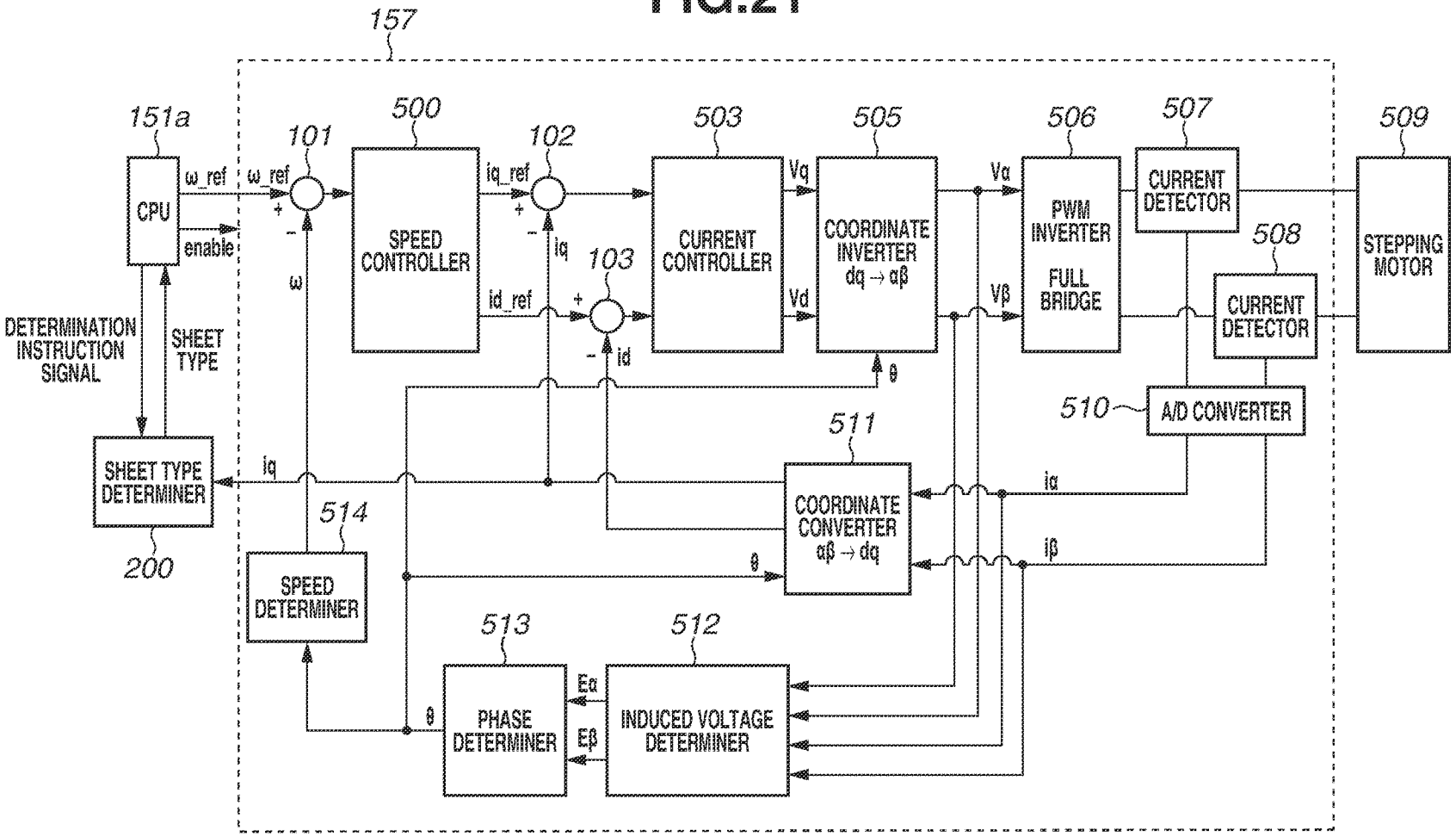
FIG. 21 is a block diagram illustrating a motor control apparatus which performs speed feedback control.

The vector control according to the first to the third embodiments, the motor is controlled by performing the phase feedback control, however, the control is not limited to the phase feedback control. For example, the motor may be controlled by feeding back a rotation speed ω of the rotor 402. Specifically, as illustrated in FIG. 21, the motor control apparatus includes a speed determiner 514 therein, and the speed determiner 514 determines the rotation speed ω based on a temporal change of the rotation phase θ output from the phase determiner 513. A following formula (11) is used to determine the speed.

$$\omega = d\theta/dt \tag{11}$$

The CPU 151*a* outputs a command speed ω_ref representing a target speed of the rotor. Further, the motor control apparatus includes a speed controller 500 therein, and the speed controller 500 generates and outputs the q axis current command value iq_ref and the d axis current command value id_ref so as to reduce a deviation between the rotation speed ω and the command speed ω_ref. A configuration may be adopted in which the motor is controlled by performing such speed feedback control.

A sheet type can be determined without using a sensor for determining the sheet type.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Applications No. 2016-192727, filed Sep. 30, 2016, and No. 2017-137182, filed Jul. 13, 2017, which are hereby incorporated by reference herein in their entirety.

What is claimed is:

1. An image forming apparatus comprising:

a first roller configured to convey a sheet;

a second roller configured to be adjacent to the first roller and installed on a downstream side from the first roller in a conveyance direction to which the sheet is conveyed;

an image forming unit configured to form an image on the sheet;

a motor configured to drive the first roller;

a phase determiner configured to determine a rotation phase of a rotor of the motor;

a controller configured to control a drive current flowing through a winding of the motor to reduce a deviation between a command phase representing a target phase of the rotor and the rotation phase determined by the phase determiner;

a current detector configured to detect the drive current flowing through the winding; and a discriminator configured to determine a type of the sheet conveyed by the first roller based on a value of the drive current detected by the current detector in a state in which the sheet is deflected while being conveyed by the first roller and not conveyed by the second roller, wherein the image forming unit includes:

an image bearing member configured to bear a toner image, a development unit configured to develop the toner image on the image bearing member, and a transfer unit configured to transfer the toner image developed on the image bearing member by the development unit to the sheet, wherein the second roller is a roller for conveying the sheet in accordance with a transfer timing at which the transfer unit transfers an image to the sheet, wherein the controller controls the motor to deflect the sheet in such a manner that the first roller conveys the sheet in the conveyance direction in a state in which a leading edge of the sheet abuts on the second roller being in a stopped state, and wherein the discriminator determines the type of the sheet conveyed by the first roller based on a value of the drive current detected by the current detector in a period in which the first roller deflects the sheet.

2. The image forming apparatus according to claim 1, wherein the controller controls a drive current flowing through the winding to reduce the deviation based on a torque current component for generating torque on the rotor which is indicated in a rotating coordinate system based on the rotation phase determined by the phase determiner, and wherein the discriminator determines the type of the sheet based on a value of the torque current component in the drive current detected by the current detector in the period in which the first roller deflects the sheet.

3. The image forming apparatus according to claim 2, wherein the discriminator determines that the sheet is a first sheet in a case that a value of the torque current component in the drive current detected by the current detector is a first value and determines that the sheet is a second sheet of which a basis weight is greater than that of the first sheet in a case that a value of the torque current component in the drive current detected by the current detector is a second value greater than the first value.

4. The image forming apparatus according to claim 2, wherein the discriminator includes:

a memory configured to obtain values of the torque current component in the drive current detected by the current detector at different timings and store a plurality of the values of the torque current component obtained at the different timings in association with the timings at which the values of the torque current component are obtained, and a change amount determiner configured to determine a change amount of a value of a torque current component per unit time in the period in which the first roller deflects the sheet based on the plurality of the values of the torque current component stored in the memory, wherein the discriminator determines that the sheet is a first sheet in a case that the change amount determined by the change amount determiner is a first value and determines that the sheet is a second sheet of which stiffness is greater than that of the first sheet in a case that the change amount determined by the change amount determiner is a second value greater than the first value.

5. The image forming apparatus according to claim 2, wherein the discriminator includes:

a memory configured to obtain values of the torque current component in the drive current detected by the current detector at different timings and store a plurality of the values of the torque current component obtained at the different timings in association with the timings at which the values of the torque current component are obtained, and a sum determiner configured to determine a sum of the values of the torque current component in the period in which the first roller deflects the sheet based on the plurality of the values of the torque current component stored in the memory, wherein the discriminator determines that the sheet is a first sheet in a case that the sum determined by the sum determiner is a first value and determines that the sheet is a second sheet of which stiffness is greater than that of the first sheet in a case that the sum determined by the sum determiner is a second value greater than the first value.

6. An image forming apparatus comprising:

a first roller configured to convey a sheet;

a second roller configured to be adjacent to the first roller and installed on a downstream side from the first roller in a conveyance direction to which the sheet is conveyed;

an image forming unit configured to form an image on the sheet;

a motor configured to drive the first roller;

a phase determiner configured to determine a rotation phase of a rotor of the motor; a controller configured to control a drive current flowing through a winding of the motor to reduce a deviation between a command phase representing a target phase of the rotor and the rotation phase determined by the phase determiner;

a current detector configured to detect the drive current flowing through the winding; and a discriminator configured to determine a type of the sheet conveyed by the first roller based on a value of the drive current detected by the current detector in a state in which the sheet is deflected while being conveyed by the first roller and not conveyed by the second roller, wherein a conveyance path through which a sheet conveyed by the first roller passes is bent between the first roller and the second roller, and wherein the discriminator determines the type of the sheet conveyed by the first roller based on a value of the drive current detected by the current detector in a state in which the sheet is deflected by not being conveyed by the second roller but being conveyed by the first roller along a bending portion at which the conveyance path is bent.

7. The image forming apparatus according to claim 6, wherein the controller controls a drive current flowing through the winding to reduce the deviation based on a torque current component for generating torque on the rotor which is indicated in a rotating coordinate system based on the rotation phase determined by the phase determiner, and wherein the discriminator determines the type of the sheet based on a value of the torque current component in the drive current detected by the current detector in the state in which the sheet is deflected by not being conveyed by the second roller but being conveyed by the first roller along the bending portion at which the conveyance path is bent.

8. The image forming apparatus according to claim 7 further comprising a sheet detector configured to detect a leading edge of the sheet on an upstream side than the first roller in the conveyance direction to which the sheet is conveyed, wherein the discriminator determines that the sheet is a first sheet in a case that a value of the torque current component in the drive current detected by the current detector is a first value when a third predetermined time elapses from when the sheet detector detects the leading edge of the sheet and determines that the sheet is a second sheet of which a basis weight is greater than that of the first sheet in a case that a value of the torque current component in the drive current detected by the current detector is a second value greater than the first value.

9. The image forming apparatus according to claim 7, wherein the discriminator includes:

a memory configured to obtain values of the torque current component in the drive current detected by the current detector at different timings and store a plurality of the values of the torque current component obtained at the different timings in association with the timings at which the values of the torque current component are obtained, and a change amount determiner configured to determine a change amount of a value of a torque current component per unit time in a period in which the sheet is deflected by not being conveyed by the second roller but being conveyed by the first roller along the bending portion at which the conveyance path is bent based on the plurality of the values of the torque current component stored in the memory, wherein the discriminator determines that the sheet is a first sheet in a case that the change amount determined by the change amount determiner is a first value and determines that the sheet is a second sheet of which stiffness is greater than that of the first sheet in a case that the change amount determined by the change amount determiner is a second value greater than the first value.

10. The image forming apparatus according to claim 7, wherein the discriminator includes:

a memory configured to obtain values of the torque current component in the drive current detected by the current detector at different timings and store a plurality of the values of the torque current component obtained at the different timings in association with the timings at which the values of the torque current component are obtained, and a sum determiner configured to determine a sum of the values of the torque current component in a period in which the sheet is deflected by not being conveyed by the second roller but being conveyed by the first roller along the bending portion at which the conveyance path is bent based on the plurality of the values of the torque current component stored in the memory, wherein the discriminator determines that the sheet is a first sheet in a case that the sum determined by the sum determiner is a first value and determines that the sheet is a second sheet of which stiffness is greater than that of the first sheet in a case that the sum determined by the sum determiner is a second value greater than the first value.

11. An image forming apparatus comprising:

a conveyance roller configured to convey a sheet;

an abutment member configured to be installed in a downstream side from the conveyance roller in a conveyance direction to which the sheet is conveyed and be contacted by a leading edge of the sheet conveyed by the conveyance roller;

an image forming unit configured to form an image on the sheet;

a motor configured to drive the conveyance roller;

a phase determiner configured to determine a rotation phase of a rotor of the motor;

a controller configured to control a drive current flowing through a winding of the motor to reduce a deviation between a command phase representing a target phase of the rotor and the rotation phase determined by the phase determiner;

a current detector configured to detect the drive current flowing through the winding;

a discriminator configured to output a signal indicating a type of the sheet conveyed by the conveyance roller based on a value of the drive current detected by the current detector;

a setting unit configured to set information of the sheet conveyed; and a notification unit configured to provide notice to a user based on the signal output from the discriminator, wherein the discriminator outputs a signal indicating the information of the sheet conveyed by the conveyance roller based on a value of the drive current detected by the current detector in a period in which the sheet is deflected by being conveyed by the conveyance roller to the conveyance direction in a state in which the leading edge abuts on the abutment member, and wherein, in a case that the information of the sheet set by the setting unit is different from the information of the sheet indicated by the signal output from the discriminator, the notification unit notifies that a sheet corresponding to the set information of the sheet is different from the sheet being conveyed.

12. An image forming apparatus comprising:

a first roller configured to convey a sheet;

a second roller configured to be adjacent to the first roller and installed on a downstream side from the first roller in a conveyance direction to which the sheet is conveyed;

an image forming unit configured to form an image on the sheet;

a motor configured to drive the first roller;

a phase determiner configured to determine a rotation phase of a rotor of the motor;

a controller configured to control a drive current flowing through a winding of the motor to reduce a deviation between a command phase representing a target phase of the rotor and the rotation phase determined by the phase determiner;

a current detector configured to detect the drive current flowing through the winding;

a discriminator configured to output a signal indicating a type of the sheet conveyed by the first roller based on a value of the drive current detected by the current detector;

a first setting unit configured to set information of the sheet to be conveyed; and a second setting unit configured to set a setting value of the image forming unit, wherein a conveyance path through which a sheet conveyed by the first roller passes is bent between the first roller and the second roller, wherein the discriminator outputs a signal indicating the information of the sheet conveyed by the first roller based on a value of the drive current detected by the current detector in a state in which the sheet is deflected by not being conveyed by the second roller but being conveyed by the first roller along a bending portion at which the conveyance path is bent, and wherein, in a case that the information of the sheet set by the first setting unit is different from the information of the sheet indicated by the signal output from the discriminator, the second setting unit changes the setting value of the image forming unit to a setting value corresponding to the sheet indicated by the signal output from the discriminator.

13. An image forming apparatus comprising:

a first roller configured to convey a sheet;

a second roller configured to be adjacent to the first roller and installed on a downstream side from the first roller in a conveyance direction to which the sheet is conveyed;

an image forming unit configured to form an image on the sheet;

a motor configured to drive the first roller;

a phase determiner configured to determine a rotation phase of a rotor of the motor;

a controller configured to control a drive current flowing through a winding of the motor to reduce a deviation between a command phase representing a target phase of the rotor and the rotation phase determined by the phase determiner;

a current detector configured to detect the drive current flowing through the winding;

a discriminator configured to output a signal indicating a type of the sheet conveyed by the first roller based on a value of the drive current detected by the current detector;

a setting unit configured to set information of the sheet conveyed; and a notification unit configured to provide notice to a user based on the signal output from the discriminator, wherein a conveyance path through which a sheet conveyed by the first roller passes is bent between the first roller and the second roller, wherein the discriminator outputs a signal indicating the information of the sheet conveyed by the first roller based on a value of the drive current detected by the current detector in a state in which the sheet is deflected by not being conveyed by the second roller but being conveyed by the first roller along a bending portion at which the conveyance path is bent, and wherein, in a case that the information of the sheet set by the setting unit is different from the information of the sheet indicated by the signal output from the discriminator, the notification unit notifies that a sheet corresponding to the set information of the sheet is different from the sheet being conveyed.

14. An image forming apparatus comprising:

a first roller configured to convey a sheet;

a second roller configured to be adjacent to the first roller and installed on a downstream side from the first roller in a conveyance direction to which the sheet is conveyed;

an image forming unit configured to form an image on the sheet;

a motor configured to drive the first roller;

a speed determiner configured to determine a rotation speed of a rotor of the motor;

a controller configured to control a drive current flowing through a winding of the motor to reduce a deviation between a command speed representing a target speed of the rotor and the rotation speed determined by the speed determiner;

a current detector configured to detect the drive current flowing through the winding; and a discriminator configured to determine a type of the sheet conveyed by the first roller based on a value of the drive current detected by the current detector in a state in which the sheet is deflected while being conveyed by the first roller and not conveyed by the second roller, wherein the image forming unit includes:

an image bearing member configured to bear a toner image, a development unit configured to develop the toner image on the image bearing member, and a transfer unit configured to transfer the toner image developed on the image bearing member by the development unit to the sheet, wherein the second roller is a roller for conveying the sheet in accordance with a transfer timing at which the transfer unit transfers an image to the sheet, wherein the controller controls the motor to deflect the sheet in such a manner that the first roller conveys the sheet in the conveyance direction in a state in which a leading edge of the sheet abuts on the second roller being in a stopped state, and wherein the discriminator determines the type of the sheet conveyed by the first roller based on a value of the drive current detected by the current detector in a period in which the first roller deflects the sheet.

15. The image forming apparatus according to claim 14, further comprising a phase determiner configured to determine a rotation phase of the rotor, wherein the controller controls a drive current flowing through the winding to reduce the deviation based on a torque current component for generating torque on the rotor which is indicated in a rotating coordinate system based on the rotation phase determined by the phase determiner, and wherein the discriminator determines the type of the sheet based on a value of the torque current component in the drive current detected by the current detector in the period in which the first roller deflects the sheet.

16. An image forming apparatus comprising:

a first roller configured to convey a sheet;

a second roller configured to be adjacent to the first roller and installed on a downstream side from the first roller in a conveyance direction to which the sheet is conveyed;

an image forming unit configured to form an image on the sheet;

a motor configured to drive the first roller;

a speed determiner configured to determine a rotation speed of a rotor of the motor;

a controller configured to control a drive current flowing through a winding of the motor to reduce a deviation between a command speed representing a target speed of the rotor and the rotation speed determined by the speed determiner;

a current detector configured to detect the drive current flowing through the winding; and a discriminator configured to determine a type of the sheet conveyed by the first roller based on a value of the drive current detected by the current detector in a state in which the sheet is deflected while being conveyed by the first roller and not conveyed by the second roller, wherein a conveyance path through which a sheet conveyed by the first roller passes is bent between the first roller and the second roller, and wherein the discriminator determines the type of the sheet conveyed by the first roller based on a value of the drive current detected by the current detector in a state in which the sheet is deflected by not being conveyed by the second roller but being conveyed by the first roller along a bending portion at which the conveyance path is bent.

17. The image forming apparatus according to claim 16, further comprising a phase determiner configured to determine a rotation phase of the rotor, wherein the controller controls a drive current flowing through the winding to reduce the deviation based on a torque current component for generating torque on the rotor which is indicated in a rotating coordinate system based on the rotation phase determined by the phase determiner, and wherein the discriminator determines the type of the sheet based on a value of the torque current component in the drive current detected by the current detector in the state in which the sheet is deflected by not being conveyed by the second roller but being conveyed by the first roller along the bending portion.

18. The image forming apparatus according to claim 11, wherein the controller controls a drive current flowing through the winding to reduce the deviation based on a torque current component for generating torque on the rotor which is represented in a rotating coordinate system based on the rotation phase determined by the phase determiner, and wherein the discriminator outputs the signal based on a value of the torque current component of the drive current detected by the current detector in the period in which the sheet is deflected by being conveyed by the conveyance roller to the conveyance direction in the state in which the leading edge abuts on the abutment member.

19. An image forming apparatus comprising:

a conveyance roller configured to convey a sheet;

an abutment member configured to be installed in a downstream side from the conveyance roller in a conveyance direction to which the sheet is conveyed and be contacted by a leading edge of the sheet conveyed by the conveyance roller;

an image forming unit configured to form an image on the sheet;

a motor configured to drive the conveyance roller;

a speed determiner configured to determine a rotation speed of a rotor of the motor;

a controller configured to control a drive current flowing through a winding of the motor to reduce a deviation between a command speed representing a target speed of the rotor and the rotation speed determined by the speed determiner;

a current detector configured to detect the drive current flowing through the winding;

a discriminator configured to output a signal indicating a type of the sheet conveyed by the conveyance roller based on a value of the drive current detected by the current detector;

a setting unit configured to set information indicating the type of the sheet to be conveyed by the conveyance roller; and a notification unit configured to provide notice to a user based on the signal output from the discriminator, wherein the discriminator outputs the signal based on a value of the drive current detected by the current detector in a period in which the sheet is deflected by being conveyed by the conveyance roller to the conveyance direction in a state in which the leading edge abuts on the abutment member, and wherein, in a case where the type of the sheet indicated by the information set by the setting unit is different from the type of the sheet indicated by the signal output from the discriminator, the notification unit notifies that the type of sheet indicated by the information set by the setting unit is different from the type of the sheet being conveyed.

20. The image forming apparatus according to claim 19, further comprising a phase determiner configured to determine a rotation phase of the rotor;

wherein the controller controls a drive current flowing through the winding to reduce the deviation based on a torque current component for generating torque on the rotor which is represented in a rotating coordinate system based on the rotation phase determined by the phase determiner, and wherein the discriminator outputs the signal based on a value of the torque current component of the drive current detected by the current detector in the period in which the sheet is deflected by being conveyed by the conveyance roller to the conveyance direction in the state in which the leading edge abuts on the abutment member.

21. The image forming apparatus according to claim 12, further comprising:

a stacking portion on which the sheet is to be stacked; and a pick up roller configured to feed the sheet stacked on the stacking portion, wherein the first roller is adjacent to the pick up roller and disposed downstream to the pick up roller in the conveyance direction.

22. The image forming apparatus according to claim 12, wherein the controller controls a drive current flowing through the winding to reduce the deviation based on a torque current component for generating torque on the rotor which is represented in a rotating coordinate system based on the rotation phase determined by the phase determiner, and wherein the discriminator outputs the signal based on a value of the torque current component of the drive current detected by the current detector in the state in which the sheet is deflected by not being conveyed by the second roller but being conveyed by the first roller along the bending portion.

23. An image forming apparatus comprising:

a first roller configured to convey a sheet;

a second roller configured to be adjacent to the first roller and installed on a downstream side from the first roller in a conveyance direction to which the sheet is conveyed;

an image forming unit configured to form an image on the sheet;

a motor configured to drive the first roller;

a speed determiner configured to determine a rotation speed of a rotor of the motor;

a controller configured to control a drive current flowing through a winding of the motor to reduce a deviation between a command speed representing a target speed of the rotor and the rotation speed determined by the speed determiner;

a current detector configured to detect the drive current flowing through the winding; and a discriminator configured to output a signal indicating a type of the sheet conveyed by the first roller based on a value of the drive current detected by the current detector, wherein a conveyance path through which a sheet conveyed by the first roller passes is bent between the first roller and the second roller, and wherein the discriminator outputs the signal based on a value of the drive current detected by the current detector in a state in which the sheet is deflected by not being conveyed by the second roller but being conveyed by the first roller along a bending portion at which the conveyance path is bent.

24. The image forming apparatus according to claim 23, further comprising:

a first setting unit configured to set information indicating the type of the sheet to be conveyed; and a second setting unit configured to set a setting value of the image forming unit, wherein, in a case where the type of the sheet indicated by the information set by the first setting unit is different from the type of the sheet indicated by the signal output from the discriminator, the second setting unit changes the setting value of the image forming unit to a setting value corresponding to the type of the sheet indicated by the signal output from the discriminator.

25. The image forming apparatus according to claim 23, further comprising:

a stacking portion on which the sheet is to be stacked; and a pick up roller configured to feed the sheet stacked on the stacking portion, wherein the first roller is adjacent to the pick up roller and disposed downstream to the pick up roller in the conveyance direction.

26. The image forming apparatus according to claim 23, further comprising a phase determiner configured to determine a rotation phase of the rotor;

wherein the controller controls a drive current flowing through the winding to reduce the deviation based on a torque current component for generating torque on the rotor which is represented in a rotating coordinate system based on the rotation phase determined by the phase determiner, and wherein the discriminator outputs the signal based on a value of the torque current component of the drive current detected by the current detector in the state in which the sheet is deflected by not being conveyed by the second roller but being conveyed by the first roller along the bending portion.

27. The image forming apparatus according to claim 23, further comprising:

a setting unit configured to set information indicating the type of the sheet to be conveyed; and a notification unit configured to provide notice to a user based on the signal output from the discriminator, wherein, in a case where the type of the sheet indicated by the information set by the setting unit is different from the type of the sheet indicated by the signal output from the discriminator, the notification unit notifies that the type of the sheet indicated by the information set by the setting unit is different from the type of the sheet being conveyed.

28. The image forming apparatus according to claim 13, further comprising:

a stacking portion on which the sheet is to be stacked; and a pick up roller configured to feed the sheet stacked on the stacking portion, wherein the first roller is adjacent to the pick up roller and disposed downstream to the pick up roller in the conveyance direction.

29. The image forming apparatus according to claim 13, wherein the controller controls a drive current flowing through the winding to reduce the deviation based on a torque current component for generating torque on the rotor which is represented in a rotating coordinate system based on the rotation phase determined by the phase determiner, and wherein the discriminator outputs the signal based on a value of the torque current component of the drive current detected by the current detector in the state in which the sheet is deflected by not being conveyed by the second roller but being conveyed by the first roller along the bending portion.

30. A sheet conveying apparatus comprising:

a first roller configured to convey a sheet;

a second roller configured to be adjacent to the first roller and disposed on a downstream side from the first roller in a conveyance direction to which the sheet is conveyed;

a motor configured to drive the first roller;

a phase determiner configured to determine a rotation phase of a rotor of the motor;

a controller configured to control a drive current flowing through a winding of the motor to reduce a deviation between a instructed phase indicating a target phase of the rotor and the rotation phase determined by the phase determiner, based on a torque current component for generating torque on the rotor which is represented in a rotating coordinate system based on the rotation phase determined by the phase determiner;

a current detector configured to detect the drive current flowing through the winding; and a discriminator configured to output a signal indicating a type of the sheet conveyed by the first roller based on a value of the torque current component of the drive current detected by the current detector in a state in which the sheet is deflected while being conveyed by the first roller and not conveyed by the second roller.

31. The sheet conveying apparatus according to claim 30, wherein a conveyance path through which a sheet conveyed by the first roller passes is bent between the first roller and the second roller, and wherein the discriminator outputs the signal based on the value of the drive current detected by the current detector in the state in which the sheet is deflected by not being conveyed by the second roller but being conveyed by the first roller along a bending portion at which the conveyance path is bent.

32. The sheet conveying apparatus according to claim 30, further comprising:

a stacking portion on which the sheet is to be stacked; and a pick up roller configured to feed the sheet stacked on the stacking portion, wherein the first roller is adjacent to the pick up roller and disposed downstream to the pick up roller in the conveyance direction.

33. The sheet conveying apparatus according to claim 30, further comprising:

a setting unit configured to set information indicating the type of the sheet to be conveyed; and a notification unit configured to provide notice to a user based on the signal output from the discriminator, wherein, in a case where the type of the sheet indicated by the information set by the setting unit is different from the type of the sheet indicated by the signal output from the discriminator, the notification unit notifies that the type of the sheet indicated by the information set by the setting unit is different from the type of the sheet being conveyed.

34. A sheet conveying apparatus comprising:

a first roller configured to convey a sheet;

a second roller configured to be adjacent to the first roller and disposed on a downstream side from the first roller in a conveyance direction to which the sheet is conveyed;

a motor configured to drive the first roller;

a phase determiner configured to determine a rotation phase of a rotor of the motor;

a speed determiner configured to determine a rotation speed of the rotor;

a controller configured to control a drive current flowing through a winding of the motor to reduce a deviation between a instructed speed indicating a target speed of the rotor and the rotation speed determined by the speed determiner, based on a torque current component for generating torque on the rotor which is represented in a rotating coordinate system based on the rotation phase determined by the phase determiner;

a current detector configured to detect the drive current flowing through the winding; and a discriminator configured to output a signal indicating a type of the sheet conveyed by the first roller based on a value of the torque current component of the drive current detected by the current detector in a state in which the sheet is deflected while being conveyed by the first roller and not conveyed by the second roller.

35. The sheet conveying apparatus according to claim 34, wherein a conveyance path through which a sheet conveyed by the first roller passes is bent between the first roller and the second roller, and wherein the discriminator outputs the signal based on the value of the drive current detected by the current detector in the state in which the sheet is deflected by not being conveyed by the second roller but being conveyed by the first roller along a bending portion at which the conveyance path is bent.

36. The sheet conveying apparatus according to claim 34, further comprising:

a stacking portion on which the sheet is to be stacked; and a pick up roller configured to feed the sheet stacked on the stacking portion, wherein the first roller is adjacent to the pick up roller and disposed downstream to the pick up roller in the conveyance direction.

37. The sheet conveying apparatus according to claim 34, further comprising:

a setting unit configured to set information indicating the type of the sheet to be conveyed; and a notification unit configured to provide notice to a user based on the signal output from the discriminator, wherein, in a case where the type of the sheet indicated by the information set by the setting unit is different from the type of the sheet indicated by the signal output from the discriminator, the notification unit notifies that the type of the sheet indicated by the information set by the setting unit is different from the type of the sheet being conveyed.

* * * * *